US005406357A

United States Patent [19]

Nakahara et al.

[11] Patent Number: 5,406,357

[45] Date of Patent: Apr. 11, 1995

[54] DEVELOPER FOR DEVELOPING ELECTROSTATIC IMAGE, IMAGE FORMING METHOD, IMAGE FORMING APPARATUS AND APPARATUS UNIT

[75] Inventors: Toshiaki Nakahara; Kazuyoshi Hagiwara; Minoru Shimojyo, all of Tokyo; Masami Fujimoto, Kawasaki; Kiyoshi Mizoe, Yokohama, all of Japan

[73] Assignee: Canon Kabushiki Kaisha, Tokyo, Japan

[21] Appl. No.: 293,162

[22] Filed: Aug. 19, 1994

Related U.S. Application Data

[63] Continuation of Ser. No. 77,864, Jun. 18, 1993, abandoned.

[30] Foreign Application Priority Data

Jun. 19, 1992 [JP] Japan ..... 4-184711

[51] Int. Cl.[6] ..... G03G 21/00

[52] U.S. Cl. ..... 355/245; 430/110; 430/904; 525/265

[58] Field of Search ..... 430/99, 111, 109, 110, 430/106, 124, 106.6, 904, 130, 137; 525/265, 308, 309, 285, 289; 355/245, 246

[56] References Cited

U.S. PATENT DOCUMENTS

| | | | |
|---|---|---|---|
| 2,297,691 | 10/1942 | Carlson | 95/5 |
| 4,555,467 | 11/1985 | Hasegawa et al. | 430/110 |
| 4,792,513 | 12/1988 | Gruber et al. | 430/110 |
| 4,877,704 | 10/1989 | Takagiwa et al. | 430/99 |
| 4,966,829 | 10/1990 | Yasuda et al. | 430/109 |
| 5,077,168 | 12/1991 | Ogami et al. | 430/109 |
| 5,112,714 | 5/1992 | Imai et al. | 430/106.6 |
| 5,130,219 | 7/1992 | Mori et al. | 430/106 |
| 5,135,833 | 8/1992 | Matsunaga et al. | 430/110 |
| 5,143,812 | 9/1992 | Mori et al. | 430/124 |
| 5,219,947 | 6/1993 | Yasuda et al. | 525/309 |
| 5,264,311 | 11/1993 | Nakano et al. | 430/109 |
| 5,268,248 | 12/1993 | Tanakawa et al. | 430/106 |
| 5,288,583 | 2/1994 | Osumi et al. | 420/126 |
| 5,298,354 | 3/1994 | Matsunaga et al. | 430/99 |
| 5,310,812 | 5/1994 | Yasuda et al. | 525/309 |
| 5,340,677 | 8/1994 | Baba et al. | 430/106.6 |

FOREIGN PATENT DOCUMENTS

| | | | |
|---|---|---|---|
| 42-23910 | 11/1957 | Japan . | |
| 43-24748 | 10/1958 | Japan . | |
| 48-47345 | 7/1973 | Japan | G03G 9/02 |
| 63-30850 | 2/1988 | Japan | G03G 5/05 |
| 63-32182 | 6/1988 | Japan | G03G 9/08 |
| 63-149669 | 6/1988 | Japan | G03G 15/02 |
| 2-123385 | 5/1990 | Japan | G03G 15/10 |
| 2-235069 | 9/1990 | Japan | G03G 9/087 |

*Primary Examiner*—A. T. Grimley
*Assistant Examiner*—Thu A. Dang
*Attorney, Agent, or Firm*—Fitzpatrick, Cella, Harper & Scinto

[57] ABSTRACT

The present invention provides a developer which is comprised of the magnetic toner having the specific binder resin component and low-molecular weight wax and the additives of the fine silica powder, metal oxide powder and fluorine-containing fine resin powder which are used in combination in given amounts. Hence, it is possible to prevent the melt-adhesion of toner to the surfaces of the contact charging member and contact transfer member, to cause no faulty images and to obtain images with the enjoyment of superior low-temperature fixing performance and anti-offset properties, even when copies are taken on a large number of sheets using the image forming method having contact charging and contact transfer systems.

42 Claims, 3 Drawing Sheets

DEVELOPER FOR DEVELOPING ELECTROSTATIC IMAGE, IMAGE FORMING METHOD, IMAGE FORMING APPARATUS AND APPARATUS UNIT

This application is a continuation of application Ser. No. 08/077,864 filed Jun. 18, 1993, now abandoned.

BACKGROUND OF THE INVENTION

1. Field of the Invention

This invention relates to a developer for developing an electrostatic image, an image forming method, an image forming apparatus and an apparatus unit that are used to convert an electrostatic latent image into a visible image in image producing processes such as electrophotography, electrostatic recording and electrostatic printing.

More particularly, the present invention relates to an image forming method having the contact sharging step of carrying out electrostatic charging by bringing a charging member to which a voltage has been externally applied, into contact with an electrostatic image bearing member, the developing step of developing an electrostatic latent image formed on the electrostatic latent image bearing member by the use of a developer and the contact transfer step of transfer a developed image to a transfer medium while a transfer member to which a voltage has been externally applied is pressed against the electrostatic image bearing member. It also relates to a developer for developing an electrostatic image, used in such an image forming method, and an image forming apparatus and an apparatus unit that have such a developer for developing an electrostatic image.

2. Related Background Art

A number of methods as disclosed in U.S. Pat. No. 2,297,691, Japanese Patent Publication Nos. 42-23910 and 43-24748 and so forth are hitherto known for electrophotography. In general, copies are obtained by forming an electrostatic latent image on a photosensitive member by utilizing a photoconductive material and by various means, subsequently developing the latent image by the use of a toner, and transferring the toner image to a recording medium such as paper if necessary, followed by fixing by the action of heat, pressure, heat-and-pressure, or solvent vapor. The toner that has not transferred to and has remained on the photosensitive member is cleaned by various means, and then the above process is repeated.

In recent years, such copying apparatus are not only used as copying machines for office work to merely take copies of originals, but also has began to be used as information output machinery connected with other information processing machines as a result of introduction of digital techniques, as copying machines for preparing new originals as a result of the achievement of multi-function that has made it easy to process or edit image information, and also as personal copying machines for private use.

Hence, the apparatus are severely sought to be made more high-speed, to achieve a higher image: quality and to be made more small-sized and lightweight, and also severely sought to be more: highly reliable.

Under such circumstances, in printers or copying machines making use of electrophotographic techniques, corona dischargers have been commonly put into wide use i) as a means for uniformly charging the surface of a photoconductor (an electrostatic image bearing member) and ii) as a means for transferring a developer-developed image on the surface of the photoconductor. However, research and development have been made on a method in which direct charging and transfer are carried out by externally applying voltages while directly bringing charging members into contact with, or pressing them against, the surface of the photoconductor, and such a method is being put into practical use.

Such a method is disclosed, for example, in Japanese Patent Applications Laid-open No. 63-149669 and No. 2-23385. These are concerned with contact charging or contact transfer, where a conductive elastic roller is brought into contact with an electrostatic image bearing member, the electrostatic image bearing member is uniformly charged while applying a voltage to the conductive roller, which is then exposed to light to form thereon an electrostatic latent image, and thereafter, while pressing against the electrostatic image bearing member another conductive elastic roller to which a voltage has been applied, a transfer medium is passed between them to transfer to the transfer medium the toner image formed on the electrostatic image bearing member, followed by fixing to obtain a copied image.

An example of the image forming method having such contact charging and contact transfer systems will be described below with reference to a schematic illustration in FIG. 4.

Reference numeral 101 denotes a rotating drum type electrostatic image bearing member (hereinafter "photosensitive member"). The photosensitive member 101 is formed of layers basically comprised of a conductive substrate layer **101*b* made of aluminum or the like and a photoconductive layer 101*a*** formed on its periphery, and is clockwise rotated as viewed in the drawing, at a given peripheral speed (process speed).

Reference numeral 102 denotes a charging roller, which is basically comprised of a mandrel at the center and a conductive elastic layer formed on its periphery. The charging roller 102 is brought into pressure contact with the surface of the photosensitive member 101 at a given pressure, and is rotates following the rotation of the photosensitive member 101. Reference numeral 103 denotes a charging bias power source through which a voltage is applied to the charging roller 102. Application of a bias to the charging roller 102 causes the surface of the photosensitive member 101 to be charged to a given polarity and potential. Image exposure 104 subsequently carried out gives formation of electrostatic latent images, which are successively converted into visible images as toner images through a developing means 105.

Reference numeral 106 denotes a transfer roller, which is basically comprised of a mandrel **106*b* at the center and a conductive elastic layer 106*a* formed on its periphery. The transfer roller 106 is brought into pressure contact with the surface of the photosensitive member 101 at a given pressure, and is rotated at a speed equal to, or different from, the peripheral speed of the photosensitive member 101. A transfer medium 108 is transported between the photosensitive member 101 and the transfer roller 106 and at the same time a bias with a polarity reverse to that of the toner is applied from a transfer bias power source 107, so that the toner image on the photosensitive member 101 is transferred to the surface of the transfer medium 108**.

Subsequently, the transfer medium 108 is transported to a fixing assembly 111 basically comprised of a fixing roller 111*a* internally provided with a halogen heater and an elastic-material pressure roller 111*b* brought into pressure contact with it at a given pressure, and is passed between the rollers 111*a* and 111*b*, so that the toner image is fixed to the transfer medium 108 and the fixed image is outputted as an image-formed article.

From the surface of the photosensitive member 101 after the toner image has been transferred, contaminants such as untransferred toner remaining adhered thereto are removed to make the surface clean by means of a cleaning assembly 109 provided with an elastic cleaning blade counter-clockwise brought into pressure contact with the photosensitive member 101. The surface is then subjected to charge elimination through a charge elimination exposure assembly 110, and is repeatedly used for image formation.

Image forming apparatus having such contact charging and contact transfer systems enable uniform charging of a photosensitive member and satisfactory transfer therefrom at a bias with a relatively low voltage compared with corona charging and corona transfer, and is advantageous for making chargers themselves small-sized and preventing corona discharge products such as ozone.

When, however, a usual developer comprising toner particles comprised of a binder resin and a colorant such as a magnetic material, to which a fluidity-imparting agent such as silica is added, is used in the image forming apparatus having contact charging and contact transfer systems, the toner particles slightly remaining on the photosensitive member that have been unremoved in the cleaning step after transfer go through the charging roller and transfer roller brought into pressure contact with the photosensitive member and may stick fast to the surfaces of both the rollers and photosensitive member. With repetition of copying, such toner particles melt-adhere to be more strongly fixed, so that faulty charging, faulty cleaning and faulty transfer may be caused. Thus, there is the problem that a decrease and uneveness in image density, white dots in solid black images and black spots in solid white images are liable to occur in the images obtained.

Various methods such as the blade method, the fur brush method and the magnetic brush method are known as methods by which the toner remaining on the photosensitive member after transfer is removed. Under the existing conditions, however, it is impossible to completely remove by these methods the toner remaining on the photosensitive member after transfer.

For the purpose of preventing this phenomenon in which toners adhere to photosensitive members, Japanese Patent Application Laid-open No. 48-47345 suggests adding both friction-decreasing substance and an abrasive substance to a toner. Since, however, the friction-decreasing substance is a substance that forms an adherent filmy deposit, a film ascribable to the friction-decreasing material may be formed on the built-in charging roller or transfer roller if such a toner is used in the image forming apparatus having contact charging and contact transfer systems, bringing about the problem that faulty charging and faulty transfer may remarkably occur.

Organic photosensitive members (organic photoconductors) are also prevalent as photosensitive members used in medium-speed machines to make copying machines small-sized and to reduce cost. In particular, for the purpose of decreasing the wear of the surface layer of an organic photosensitive member to prevent deterioration of its charge performance, Japanese Patent Application Laid-open No. 63-30850 suggests an organic photosensitive member having a surface layer containing a lubricant such as a fine fluorine resin powder. The organic photosensitive member containing such a lubricant can certainly enjoy a longer lifetime of the photosensitive member itself.

However, because of a poor dispersibility of the lubricant in a binder resin such as polycarbonate that constitutes the surface layer, its use may conversely cause a decrease in smoothness of the surface of the photosensitive member, so that, if the photosensitive member is used in the image forming apparatus having contact charging and contact transfer systems, the toner after development may get into concaved portions on the surface to cause a great lowering of the cleaning performance when the remaining toner is removed in the cleaning step after transfer, tending to worsen the phenomenon of melt-adhesion of toner to the charging roller and transfer roller and to the photosensitive member.

In relation to the step of fixing toner images to transfer mediums such as transfer paper, the method most prevalent at present is the heat-pressure system using a heating roller, i.e., what is called the heat-roll fixing system. In the heat-roll fixing system, a waiting time is required until the heating roller reaches a given temperature. As this waiting time is made shorter and the apparatus is made higher in speed, faulty fixing tends to be caused by a drop of temperature of the heating roller due to the passage of the transfer medium, and instantaneous fixing on the transfer medium is liable to occur. Moreover, since the heating roller surface comes into contact with toner images in the state the toner is molten, a part of the toner images may adhere to the surface of a fixing roller, which is transferred thereto and may be further transferred to the subsequent transfer medium, so that the so-called offset phenomenon is liable to occur.

For this reason, improvements in fixing performance of the developer have been made, and a proposal is made in Japanese Patent Publication No. 63-32182 for the purpose of improving a low-temperature fixing performance of toners. In this publication, a toner containing as a binder resin component of the toner a vinyl polymer having at least one peak in each of specific regions of low-molecular weight and high-molecular weight is proposed, which contains the low-molecular weight component in a relatively large amount so that the low-temperature fixing performance can be improved. In another disclosure in Japanese Patent Application Laid-open No. 2-235069, a magnetic toner comprises a binder resin having two peak values in its molecular weight distribution, in which, setting a bottom value between both the peak values as a reference point, each of the dispersion ratios in the low-molecular weight region to that in the high-molecular weight region is made small to improve low-temperature fixing performance and anti-offset properties.

Although the toner as described above is improved in fixing performance, there is the problem that the use of such a toner in the image forming apparatus having contact charging and contact transfer systems tends to worsen the phenomenon of melt-adhesion of toner on the charging roller and transfer roller and on the photosensitive member.

Moreover, even if a cleaning member such as a felt pad or an elastic blade is set in contact with both the rollers so that contaminants such as paper dust produced from transfer mediums such as paper can be prevented from adhering to the charging roller and the transfer roller, the toner may so strongly melt-adhere to the both rollers that it is difficult to decrease faulty cleaning.

SUMMARY OF THE INVENTION

An object of the present invention is to provide a developer for developing an electrostatic image, an image forming method, an image forming apparatus and an apparatus unit, which have solved the problems discussed above.

Another object of the present invention is to provide a developer for developing an electrostatic image, an image forming method, an image forming apparatus and an apparatus unit that cause almost no or no melt-adhesion of toner on a contact charging member, a contact transfer member and a photosensitive member.

Still another object of the present invention is to provide a developer for developing an electrostatic image, an image forming method, an image forming apparatus and an apparatus unit, which have been improved in cleaning performance of the toner adhering to a contact charging member, a contact transfer member or a photosensitive member.

A further object of the present invention is to provide a developer for developing an electrostatic image, an image forming method, an image forming apparatus and an apparatus unit, which cause almost no or no faulty images even when copies are taken on a large number of sheets using the image forming apparatus having contact charging and contact transfer systems, and at the same time can achieve superior low-temperature fixing performance and anti-offset properties.

The present invention provides a developer for developing an electrostatic image, comprising i) a magnetic toner containing 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,000, not more than 20% by weight of a medium-molecular weight component in the medium-molecular weight region of a molecular weight of not less than 100,000 to less than 300,000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder.

The present invention also provides an image forming method comprising;

bringing a contact charging member into contact with the surface of an electrostatic image bearing member and applying a bias voltage to electrostatically charge said electrostatic image bearing member;

forming an electrostatic image on the electrostatically charged electrostatic image bearing member through a latent image forming means;

developing the electrostatic latent image which said electrostatic image bearing member bears, by the use of a developer; said developer comprising i) a magnetic toner containing, 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,000, not more than 20% by weight of a medium-molecular weight component in the medium-molecular weight region of a molecular weight of not less than 100,000 to less than 300,000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder;

transferring a developed image formed by development, to a transfer medium by means of a contact transfer member brought into contact with the surface of the electrostatic image bearing member interposing the transfer medium between them; and fixing the developed image on the transfer medium through a fixing means.

The present invention still also provides an image forming apparatus comprising;

an electrostatic image bearing member capable of bearing an electrostatic latent image;

a contact charging member brought into contact with the surface of said electrostatic image bearing member and capable of electrostatically charging said electrostatic image bearing member upon application of a bias voltage;

a latent image forming means capable of forming an electrostatic latent image on the electrostatically charged electrostatic image bearing member;

a developing means capable of developing the electrostatic latent image which said electrostatic image bearing member bears; said developing means holding a developer; said developer comprising i) a magnetic toner containing at least, 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,000, not more than 20% by weight of a medium-molecular weight component in the medium-molecular weight region of a molecular weight of not less than 100,000 to less than 300,000, and from 5% by weight to 30% by weight of a high-molecular weight component in the high-molecular weight region of a molecular weight of not less than 500,000, based on THF-soluble matter; and said additives comprise from 0.1% by weight to 24 by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder;

a contact transfer member brought into contact With the surface of the electrostatic image bearing member interposing a transfer medium between them, capable of transferring to the transfer medium a developed image formed by the developing means; and a fixing means capable of fixing the developed image on the transfer medium.

The present invention further provides an apparatus unit comprising an electrostatic image bearing member capable of bearing an electrostatic latent image, and a contact charging member brought into contact with the surface of said electrostatic image bearing member and capable of electrostatically charging said electrostatic image bearing member upon application of a bias voltage; at least one of said members being held into one unit together with a developing means capable of developing the electrostatic latent image which said electrostatic image bearing member bears;

said unit being detachably mounted in the: body of an apparatus having;

a latent image forming means capable of forming an electrostatic latent image on the electrostatically charged electrostatic image bearing member;

a contact transfer member brought into contact with the surface of the electrostatic image bearing member interposing a transfer medium between them, capable of transferring to the transfer medium a developed image formed by the developing means; and a fixing means capable of fixing the toner image on the transfer medium;

said developing means holding a developer; said developer comprising i) a magnetic toner containing at least, 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,000, not more than 20% by weight of a medium-molecular weight component in the medium-molecular weight region of a molecular weight of not less than 100,000 to less than 300,000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder.

DESCRIPTION OF THE PREFERRED EMBODIMENTS

Figure 1:
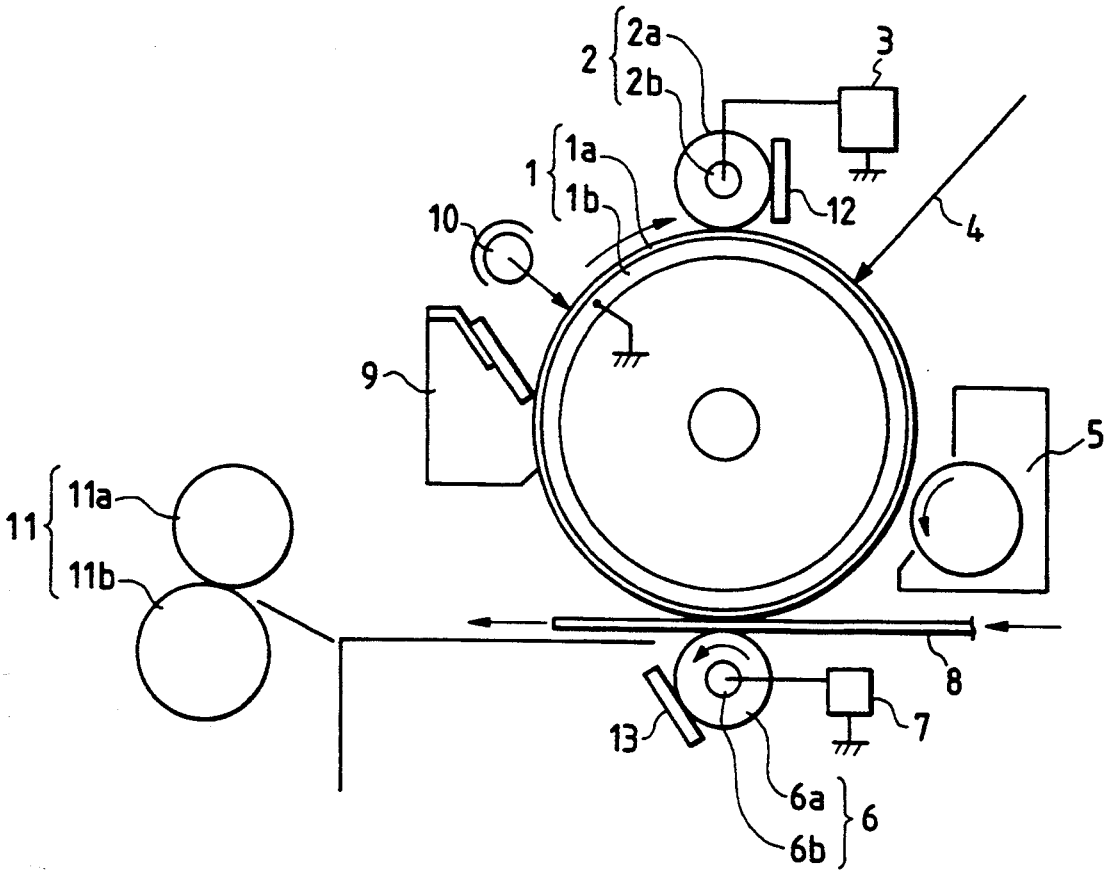
FIG. 1 is a schematic structural view to illustrate the image forming method and image forming apparatus employing the contact charging system and contact transfer system of the present invention.

Developers must be made to have an excellent low-temperature fixing performance and anti-offset properties and at the same time, even when the developers are used in the image forming apparatus having contact charging and contact transfer systems, to have a sufficient releasability from the charging member and transfer member and also from the photosensitive member so that they can retain the performance promising a sufficient abrasive power against the adhesion of toner on the charging member and transfer member. The present inventors have found that conventional toners have problems on the phenomenon of melt-adhesion of toner on the charging member and transfer member and on the photosensitive member and the phenomenon of faulty cleaning caused by toner on the charging member and transfer member. They made studies on this point and have accomplished the present invention.

The reasons why the developer for developing an electrostatic image (hereinafter "the developer") can achieve the above objects are considered as follows: Incorporation of the fine silica powder prevents paper dust produced from a transfer medium from adhering to and remaining on the contact charging member, contact transfer member and photosensitive member because of its very slightly abrasive power. Incorporation of the fluorine-containing fine resin powder makes it hard for toner particles to directly adhere to the surfaces of the contact charging member, contact transfer member and photosensitive member and at the same time brings about an improvement in release properties of the toner particles from the surfaces to prevent sticking itself of the toner. Besides, owing to incorporation of the metal oxide powder, even when the toner particles adhere to the surfaces of the contact charging member and contact transfer member and the surface of the photosensitive member, interposition of the metal oxide powder and a very small frictional force due to a slight rub occurring between the photosensitive member and each of the contact charging member and the contact transfer member, always change the positions at which the toner particles adhere, within the contact charging member, the contact transfer member or the photosensitive member, or therebetween and the toner particles by no means stay at the same position. Hence, the toner particles do not come to stick fast thereon, and also, because of an abrasive power of the developer, the cleaning performance for the toner particles having adhered to the surfaces of the contact charging member and contact transfer member can be well improved when cleaning members are brought into contact with the contact charging member and the contact transfer member, where the constitution of the low-molecular weight component, medium-molecular weight component and high-molecular weight component of the binder resin contained in the toner contributes the improvement in low-temperature fixing performance and anti-offset properties.

The binder resin component contained in the magnetic toner of the developer of the present invention must have, in a chromatogram measured by GPC (gel permeation chromatography), from 50% by weight to 90% by weight of a low-molecular weight component in the low-molecular weight region of a molecular weight of from 500 to less than 100,000, not more than 20% by weight of a medium-molecular weight component in the medium-molecular weight region of a molecular weight of from 100,000 to less than 300,000, and from 5% by weight to 30% by weight of a high-molecular weight component in the high-molecular weight region of a molecular weight of not less than 500,000, based on THF-soluble matter.

Here, if, in a chromatogram measured by GPC, the low-molecular weight component in the low-molecular weight region of a molecular weight of from 500 to less than 100,000 is less than 50% by weight or the the high-molecular weight component in the high-molecular weight region of a molecular weight of not less than 500,000 is more than 30% by weight, the low-temperature fixing performance may become poor. If the low-molecular weight component in the low-molecular weight region of a molecular weight of from 500 to less than 100,000 is more than 90% by weight or the the high-molecular weight component in the high-molecular weight region of a molecular weight of not less than 500,000 is less than 50% by weight, the anti-offset properties may become poor. If the medium-molecular weight component in the medium-molecular weight region of a molecular weight of from 100,000 to less than 300,000 is more than 20% by weight, either the low-temperature fixing performance or the anti-offset properties or both of them may become poor.

There are no particular limitations on the manner by which the binder resin component contained in the magnetic toner of the developer of the present invention is made to have, in a chromatogram measured by GPC, from 50% by weight to 90% by weight of a low-molecular weight component in the low-molecular weight region of a molecular weight of from 500 to less than 100,000, not more than 20% by weight of a medium-molecular weight component in the medium-molecular weight region of a molecular weight of from 100,000 to less than 300,000, and from 5% by weight to 30% by weight of a high-molecular weight component in the high-molecular weight region of a molecular weight of not less than 500,000. For example, two or three kinds of polymers, i) a low-molecular weight polymer having, in a chromatogram of GPC, a peak value of molecular weight in the molecular weight region of 5,000 to 60,000 and also a value of weight average molecular weight (Mw)/number average molecular weight (Mn) of not more than 15 and ii) a high-molecular weight polymer or/and a cross-linked polymer having a peak value of molecular weight in the molecular weight region of 300,000 to 1,000,000 and also a value of Mw/Mn of not more than 40, are first prepared in an amount for each polymer and then mixed by dissolving or swelling them in a solvent capable of dissolving the polymers or a solvent capable of swelling them, followed by removal of the solvent to give a binder resin. Using this binder resin, the resin may be so adjusted that the chromatogram come to be within the range of the present invention, in the course of its melt-kneading when the toner is produced. Alternatively, each amount of the polymers may be so adjusted that the chromatogram come to be within the range defined in the present invention, in the course of their melt-kneading when the toner is produced.

The polymers may be synthesized by any processes such as bulk polymerization, solution polymerization, suspension polymerization and emulsion polymerization. As a process for synthesizing the polymer having, in a chromatogram of GPC, a peak value of molecular weight in the region of a molecular weight of 5,000 to 60,000 and also a value of Mw/Mn of not more than 15, solution polymerization or emulsion polymerization is preferred. A polymerization initiator used to synthesize the polymer may include radical initiators as exemplified by t-butyl peroxy-2-ethylhexanoate, t-butyl peroxylaurate, benzoyl peroxide, lauroyl peroxide, octanoyl peroxide, di-di-t-butyl peroxide, t-butyl cumylperoxide, diisopropylbenzene hydroperoxide, p-menthane hydroperoxide, 2,2'-azobisisobutyronitrile, 2,2'-azobis(2-methylbutyronitrile) and 2,2'-azobis(4-methoxy-2,4-dimethylvaleronitrile), which may be used alone or in the form of a mixture. The radical polymerization initiator may suitably be used in an amount of from 0.1% to 15% by weight, and preferably from 1% to 10% by weight, based on the weight of monomers constituting the polymer.

As a process for synthesizing the polymer having, in a chromatogram of GPC, a peak value of molecular weight in the region of a molecular weight of 300,000 to 1,000,000 and also a value of Mw/Mn of not more than 40, any of bulk polymerization, solution polymerization, suspension polymerization and emulsion polymerization may be used. Suspension polymerization, which enables easy adjustment of molecular weight, is preferred.

As an initiator for polymerizing monomers, a bifunctional radical initiator should be used, which may include bifunctional radical polymerization initiators as exemplified by 1,1-bis(t-butylperoxy)-3,3,5-trimethylcyclohexane, 1,1-bis(t-butylperoxy)cyclohexane, 1,4-bis(t-butylperoxy)cyclohexane, 2,2-bis(t-butylperoxy)octane, n-butyl-4,4-bis(t-butylperoxy) valylate, 2,2-bis(t-butylperoxy)butane, 1,3-bis(t-butylperoxy-isopropyl)benzene, 2,5-dimethyl-2,5-di(t-butylperoxy)hexane, 2,5-dimethyl-2,5-di(t-butylperoxy)hexane-3, 2,5-dimethyl-2,5-di(t-benzoylperoxy)hexane, di-t-butyl peroxyisophthalate, 2,2-bis(4,4-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butyl peroxycarbonate) and di-t-butyl peroxytrimethyladipate. These can be used alone or in the form of a mixture, or may be used optionally in combination with other monofunctional radical initiator. Any of these radical polymerization initiators may suitably be used in an amount of from 0.05% to 5% by weight, and preferably from 0.1% to 3% by weight, based on the weight of monomers constituting the polymer.

The binder resin used in the present invention may include vinyl resins, polyester resins and epoxy resins. Of these, vinyl resins are preferred. Styrene polymers or styrene copolymers are particularly preferred.

Monomers for synthesizing the styrene polymers may include styrenes as exemplified by styrene, α-methylstyrene, vinyltoluene, and chlorostyrene. Monomers for synthesizing the styrene copolymers may include those as exemplified by acrylic acid and acrylates such as methyl acrylate, ethyl acrylate, propyl acrylate, butyl acrylate, octyl acrylate, 2-ethylhexyl acrylate, n-tetradecyl acrylate, n-hexadecyl acrylate, lauryl acrylate, cyclohexyl acrylate, diethylaminoethyl acrylate, and dimetylaminoethyl acrylate; and also methacrylic acid and methacrylates such as methyl methacrylate, ethyl methacrylate, propyl methacrylate, butyl methacrylate, amyl methacrylate, hexyl methacrylate, 2-ethylhexyl methacrylate, octyl methacrylate, decyl methacrylate, dodecyl methacrylate, lauryl methacrylate, cyclohexyl methacrylate, phenyl methacrylate, 2-hydroxyethyl methacrylate, 2-hydroxypropyl methacrylate, dimethylaminoethyl methacrylate, glycidyl methacrylate, and stearyl methacrylate. Other monomers may also include those as exemplified by acrylonitrile, 2-vinylpyridine, 4-vinylpyridine, vinylcarbazole, vinyl methyl ether, butadiene, isoprene, maleic anhydride, maleic acid, maleic acid monoesters, maleic acid diesters, and vinyl acetate. These monomers are used alone or in combination of two or more, together with the above styrene monomers.

The cross-linked polymer may be synthesized by any processes such as bulk polymerization, solution polymerization, suspension polymerization and emulsion polymerization. Suspension polymerization is preferred. The above polymerization initiator and monomers and besides a cross-linkable monomer may be added to synthesize the polymer. The cross-linkable monomer may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether bond, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds in which the acrylate moieties of the foregoing compounds have been replaced with methacrylate; diacrylate compounds linked with a chain containing an aromatic group and an ether bond, as exemplified by polyoxythylene(2)-2,2-bis(4-hydroxyphenyl)propane diacrylate, polyoxythylene(4)-2,2-bis(4-hydroxyphenyl)propane diacrylate, and compounds in which the acrylate moieties of the foregoing compounds have been replaced with methacrylate; and polyester type diacrylate compounds as exemplified by MANDA (trade name; available from Nippon Kayaku Co., Ltd.). It is also possible to use polyfunctional cross-linkable monomers such as pentaerythritol triacrylate, trimethylolethane triacrylate, trimethylolpropane triacrylate, tetramethylolmethane tetraacrylate, oligoester acrylate, and compounds in which the acrylate moieties of the foregoing compound have been replaced with methacrylate; triallylcyanurate, and triallyltrimellitate.

Any of these cross-linkable monomers may preferably be used in an amount of from 0.01 part by weight to 5 parts by weight, and more preferably from 0.03 part by weight to 3 parts by weight, based on 100% by weight of other monomer components constituting the cross-linked polymer.

In the magnetic toner according to the present invention, the following compound may be contained in addition to the above binder resin component in an amount smaller than the content of the binder resin component. Such a compound may include, for example, silicone resin, polyester, polyurethane, polyamide, epoxy resin, polyvinyl butyral, rosin, modified rosin, terpene resin, phenol resin, aromatic or alicyclic hydrocarbon resin, aromatic petroleum resin, chlorinated paraffin and paraffin wax.

The low-molecular weight wax contained in the magnetic toner of the present invention may include the following: Aliphatic hydrocarbon waxes such as low-molecular weight polyethylene, low-molecular weight polypropylene, microcrystalline wax and paraffin wax; oxides of aliphatic hydrocarbon waxes, such as oxidized polyethylene wax; block copolymers of these; waxes mainly composed of an aliphatic ester, such as carnauba wax, sazole wax and motanate wax; and waxes obtained by deoxidizing partly or wholly fatty acid esters, such as deoxidized carnauba wax. It may also include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebisstearic acid amide, ethylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-bisdioleyladipic acid amide and N,N'-bisdioleylcebasic acid amide; aromatic bisamides such as m-xylenebisstearic acid amide and N,N'-distearylisophthalic acid amide; fatty acid metal: salts (what are commonly called metal soaps) such as calcium stearate, calcium laurate, zinc stearate and magnesium stearate; waxes obtained by grafting vinyl monomers such as styrene and acrylic acid into aliphatic hydrocarbon waxes; partially esterified products of fatty acids such as behenic acid monoglyceride with polyhydric alcohols; and methyl ester compounds having a hydroxyl group, obtained by hydrogenation of vegetable fats and oils.

The magnetic toner used in the present invention may preferably contain the low-molecular weight wax in an amount of from 0.1 part to 20 parts by weight, and more preferably from 0.5 part to 10 parts by weight, based on 100 parts by weight of the binder resin component.

The low-molecular weight wax is incorporated into the binder resin usually by a method in which the binder resin is dissolved in a solvent and the resulting resin solution is added and mixed at an elevated temperature with stirring, or by a method in which it is mixed when toner component materials are melt-kneaded in the production of the toner.

In the present invention, the molecular weight distribution in the chromatogram obtained by GPC is measured under the following conditions, using THF (tetrahydrofuran) as a solvent.

Columns are stabilized in a heat chamber of 40° C. To the columns kept at this temperature, THF as a solvent is flowed at a flow rate of 1 ml per minute, and about 100 μl of THF sample solution is injected thereinto to make measurement. In measuring the molecular weight of the sample, the molecular weight distribution of the sample is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Toso Co., Ltd. or Showa Denko KK., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Toso Co., Ltd.

In the present invention, LC-GPC150C (manufactured by Waters Co.) is used as the GPC measuring apparatus, and Shodex KF-801, KF-802, KF-803, KF-804, KF-805, KF-806, KF-807 and KF-800P (available from Showa Denko K.K.) are used as the columns.

The sample is prepared in the following way: The magnetic toner containing the binder resin is put in THF, and is left to stand for several hours, followed by thorough shaking so as to be well mixed with the THF (until coelescent matter of the sample has disappeared), which is further left to stand for at least 12 hours. At this time, the sample is so left as to stand in THF for at least 24 hours in total. Thereafter, the solution having been passed through a sample-treating filter (pore size: 0.45 to 0.5 μm; for example, MAISHORI DISK H-25-5, available from Toso Co., Ltd. or EKICHRO DISK 25CR, available from German Science Japan, Ltd., can be utilized) is used as the sample for GPC. The sample is so adjusted to have resin components in a concentration of from 3 to 7 mg/ml.

The whole molecular weight distribution is measured by GPC, of the binder resin in the present invention refers to molecular weight distribution obtained by measurement of molecular weight of 500 or more.

The magnetic toner of the present invention contains a magnetic material, which may also serve as a colorant. The magnetic material contained in the magnetic toner of the present invention may include iron oxides such as magnetite, γ-iron oxide ferrite and iron-excess type ferrite; metals such as iron cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having an average particle diameter of from 0.1 to 1 μm, and more preferably from 0.1 to 0.5 μm, in approximation. Any of these materials should be contained in the magnetic toner preferably in an amount of from 50 to 120 parts by weight, and particularly preferably from 65 to 100 parts by weight, based on 100 parts by weight of the resin component.

In the magnetic toner of the present invention, a charge control agent may preferably be used by compounding it into toner particles (internal addition) or blending it with toner particles (external addition). The charge control agent enables control of optimum electrostatic charges in conformity with developing systems. Particularly in the present invention, it can make more stable the balance between binder resin and charge.

A positive charge control agent may include Nigrosine and products modified with a fatty acid metal salt; quaternary ammonium salts such as tributylbenzylammonium 1-hydroxy-4-naphthosulfonate and tetrabutylammonium tetrafluoroborate; diorganotin oxides such as dibutyltin oxide, dioctyltin oxide and dicyclohexyltin oxide; and diorganotin borates such as dibutyltin borate, dioctyltin borate and dicyclohexyltin borate; any of which may be used alone or in combination of two or more kinds. Of these, Nigrosine type or quaternary ammonium salt type charge control agents may particularly preferably be used. Homopolymers of monomers represented by the formula:

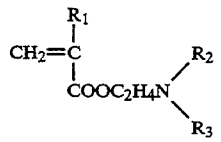

wherein $R_1$ represents H or $CH_3$, and $R_2$ and $R_3$ each represent a substituted or unsubstituted alkyl group, preferably $C_1$ to $C_4$;

or copolymers of polymerizable monomers such as styrene, acrylates or methacrylates as described above may also be used as positive charge control agents. In this case, these charge control agents can also act as binder resins (as a whole or in part).

As a negative charge control agent usable in the present invention, for example, organic metal complexes and chelate compounds are effective, as exemplified by aluminumacetylacetonato, iron (II) acetylacetonato and chromium 3,5-di-tert-butylsalicylate. In particular, acetylyacetone metal complexes, salicylic acid type metal complexes, or salts thereof are preferred. In particular, salicylic acid type metal complexes (including those substituted with monoalkyl and those substituted with dialkyl) or salicylic acid type metal salts (including those substituted with monoalkyl and those substituted with dialkyl) are more preferred.

The charge control agents described above (those having no action as binder resins) may preferably be used in the form of fine particles. In this case, the charge control agent may preferably have a number average particle diameter of specifically 4 μm or less, and more preferably 3 μm or less.

When internally added to the toner particles, such a charge control agent may preferably be used in an amount of from 0.1 part to 20 parts by weight, and more preferably from 0.2 part to 10 parts by weight, based on 100 parts by weight of the binder resin.

The magnetic toner according to the present invention may optionally be mixed with various additives by internal addition or external addition. As colorants, dyes and pigments conventionally used can be used, which should preferably be used in an amount of usually from 0.5 part to 20 parts by weight based on 100 parts of the binder resin. Other additives may include, for example, lubricants such as zinc stearate; anti-caking agents; and conductivity-providing agents such as carbon black and tin oxide.

The magnetic toner of the present invention can be produced in the following way: Magnetic iron oxide; the binder resin containing the low-molecular weight wax, or the low-molecular weight wax and the binder resin; and optionally a pigment or dye as a coloring agent, a charge control agent and other additives, are thoroughly mixed using a mixing machine such as a ball mill, and then the mixture is melt-kneaded using a heat kneading machine such as a heating roll, a kneader or an extruder to make the resin and so on melt one another, in which a pigment or dye is then dispersed or dissolved, followed by cooling for solidification and thereafter pulverization and classification. Thus, the magnetic toner according to the present invention can be obtained.

The developer according to the present invention contains a fine silica powder, a metal oxide powder and a fluorine-containing fine resin powder which are, as additives, externally added to and mixed with the magnetic toner.

As the fine silica powder used in this instance, both of fine silica powder produced by the dry process and that produced by the wet process can be used. In view of anti-filming and durability, it is preferred to use the dry process fine silica powder.

The dry process herein referred to is a process for producing fine silica powder formed by vapor phase oxidation of a silicon halide. For example, it is a process that utilizes heat decomposition oxidation reaction in the oxyhydrogen of silicon tetrachloride gas. The reaction basically proceeds as follows.

$$SiCl_4+2H_2+O_2 \rightarrow SiO_2+4HCl$$

In this production step, it is also possible to use other metal halide such as aluminum chloride or titanium chloride together with the silicon halide to give a composite fine powder of silica with other metal oxide. The fine silica powder of the present invention includes these, too.

Commercially available fine silica powders usable in the present invention, which are produced by the vapor phase oxidation of the silicon halide, include, for example, those which are on the market under the following trade names. Aerosil 130, 200, 300, 380, OX50, TT600, MOX80, MOX170, COK84 (Aerosil Japan, Ltd.); Ca-O-SiL M-5, MS-7, MS-75, HS-5, EH-5 (CABOT CO.); Wacker HDK N20, V15, N20E, T30, T40 (WACKER-CHEMIE GMBH); D-C Fine Silica (Dow-Corning Corp.); and Fransol (Franzil Co.).

As a method in which the fine silica powder used in the present invention is produceed by the wet process, conventionally known various methods can be used. For example, there is a method in which sodium silicate is decomposed using an acid, as shown by the following reaction formula.

$$Na_2O.xSiO_2+HCl+H_2O \rightarrow SiO_2.nH_2O+NaCl$$

Besides, there are a method in which sodium silicate is decomposed using an ammonium salt or alkali salt, a method in which an alkaline earth metal silicate is produced from sodium silicate, followed by decomposition using an acid to give silicic acid, a method in which an aqueous sodium silicate solution is passed through an ion-exchange resin to give silicic acid, and a method making the use of naturally occurring silicic acid or silicate.

To the fine silica powder herein referred to, it is possible to apply any of anhydrous silicon dioxide (colloidal silica), and other silicates such as aluminum silicate, sodium silicate, potassium silicate, magnesium silicate and zinc silicate.

Commercially available fine silica powders produced by the wet process include, for example, those which are on the market under the following trade names.

| | |
|---|---|
| Carplex | Shionogi & Co., Ltd. |
| Nipsil | Nippon Silica Industrial Co., Ltd. |
| Tokusil, Finesil | Tokuyama Soda Co., Ltd. |
| Vitasil | Taki Seihi Co. |
| Silton, Silnex | Mizusawa Industrial Chemicals, Ltd. |
| Starsil | Kamishima Kagaku Co. |
| Himesil | Ehime Yakuhin Co. |
| Sairoid | Fuji-Davison Chemical Ltd. |
| Hi-Sil | Pittsburgh Plate Glass Co. |
| Durosil | Fiillstoff-Gesellschaft Marquart |
| Ultrasil | " |
| Manosil | Hardman and Holden |
| Hoesch | Chemische Fabrik Hoesch K-G |
| Sil-Stone | Stone Rubber Co. |
| Nalco | Nalco Chemical Co. |
| Quso | Philadelphia Quartz Co. |
| Imsil | Illinois Minerals Co. |
| Calcium Silikat | Chemische Fabrik Hoesh K-G |
| Calsil | Füllstoff-Gesellschaft Marquart |
| Fortafil | Imperial Chemical Industries, Ltd. |
| Microcal | Joseph Crosfield & Sons, Ltd. |
| Manosil | Hardman and Holden |
| Vulkasil | Farbenfabiken Bryer, A.-G. |
| Tufknit | Durham Chemicals, Ltd. |
| Silmos | Shiraishi kogyo Co. |
| Starlex | Kamishima Kagaku Co. |
| Fricosil | Taki Seihi Co. |

Of the above fine silica powders, a fine silica powder having a surface specific area, as measured by the BET method using nitrogen absorption, of not less than 30 $m^2/g$, and particularly in the range of from 50 to 400 $m^2/g$, can give good results.

The magnetic toner must contain the fine silica powder in an amount of from 0.1 part to 2.0 parts by weight, and preferably from 0.2 part to 1.8 parts by weight, based on 100 parts by weight of the magnetic toner.

In the case where the magnetic toner used in the present invention is used as a positively chargeable magnetic toner, a positively chargeable fine silica powder, rather than a negatively chargeable one, may more preferably be used as the fine silica powder added for inhibiting the abrasion of toner, because the charge stability is not damaged.

As methods of obtaining the positively chargeable fine silica powder, there are a method in which the untreated fine silica powder as described above is treated with a silicone oil having an organo group having at least one nitrogen atom on its side chain, and a method in which it is treated with a nitrogen-containing silane coupling agent, or a method in which it is treated with both of these.

In the present invention, the positively chargeable silica refers to those having a plus triboelectric charge with respect to iron powder carrier when measured by the blow-off method.

As the silicone oil having a nitrogen atom on the side chain, which is used in treating the fine silica powder is treated, it is possible to use a silicone oil having at least a unit structure represented by the following formula:

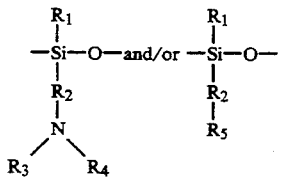

wherein $R_1$ represents a hydrogen atom, an alkyl group, an aryl group or an alkoxyl group; $R_2$ represents an alkylene group or a phenylene group; $R_3$ and $R_4$ each represent a hydrogen atom, an alkyl group or an aryl group; and $R_5$ represents a nitrogen-containing heterocyclic group.

In the above formula, the alkyl group, aryl group, alkylene group and phenylene group may each have an organo group having a nitrogen atom, or may have a substituent such as a halogen so long as the charge performance is not damaged.

The nitrogen-containing silane coupling agent used in the present invention generally have a structure represented by the following formula:

$$R_m—Si—Y_n$$

wherein R represents an alkoxyl group or a halogen atom; Y represents am amino group or an organo group having at least one nitrogen atom; and m and n are each an integer of 1 to 3, provided that m+n=4.

The organo group having at least one nitrogen atom can be exemplified by an amino group having an organic group as a substituent, a nitrogen-containing heterocyclic group, or a group having a nitrogen-containing heterocyclic group.

The nitrogen-containing heterocyclic group may include unsaturated heterocyclic groups or saturated heterocyclic groups, and known groups can be applied for these. The unsaturated heterocyclic groups can be derived from the following:

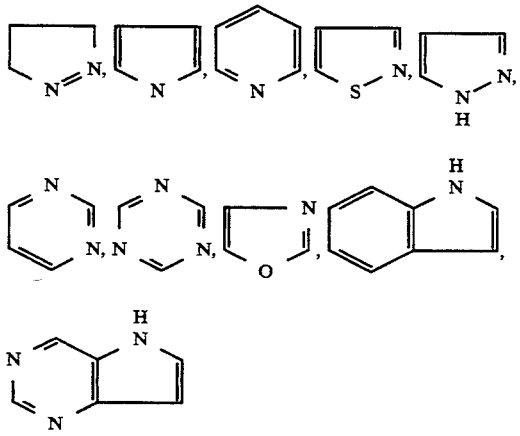

The saturated heterocyclic groups can be derived from the following:

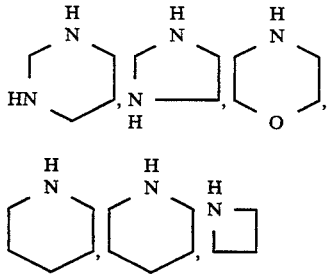

The heterocyclic groups used in the present invention should preferably be those of structure of 5 members or 6 members, taking account of stability.

Examples of such treating agents may be aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyldimethoxysilane, monobutylaminopropyltriethoxylsilane, dioctylaminopropyltriethoxysilane, dibutylaminopropyltrimethoxysilane, dibutylaminopropylmonomethoxysilane, dimethylaminophenyltriethoxysilane, trimethoxysilyl-γ-propylphenylamine and trimethoxysilyl-γ-propylbenzylamine. As the nitrogen-containing heterocyclic group, those having the above structure can be used. Examples of such compounds may be trimethoxysilyl-γ-propylpiperidine, trimethoxysilyl-γ-propylmorphorine and trimethoxysilyl-γ-propylimidazole.

These treated fine silica powder can be effective when it is applied in an amount of from 0.1 to 2.0% by weight based on the weight of the magnetic toner, and, in particular, can be well effective when added in an amount of from 0.2 to 1.5% by weight. Here, addition of the fine silica powder in an amount more than 2% by weight may bring about excessively low agglomerating properties of the developer to cause a lowering of cleaning performance for the toner particles in the cleaning step after transfer, tending to cause contamination of the contact charging member and the contact transfer member. On the other hand, addition of the fine silica powder in an amount less than 0.1% by weight is not preferable since it may cause a lowering of the abrasive power of the developer, making it not well effective to prevent paper dust produced from the transfer medium, from adhering to and remaining on the contact charging member, contact transfer member and photosensitive member.

As an embodiment for the mode of addition of the surface-treated fine silica powder described above, a state is preferred that the fine silica powder is adhered to the toner particle surfaces of the magnetic toner.

The fine silica powder used in the present invention may be optionally treated with a treating agent such as a silane coupling agent or an organic silicon compound for the purpose of making the powder hydrophobic, where it is treated with the tearing agent capable of reacting with or physically adsorbing to the fine silica powder. The organic silicon compound may include, for example, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, tirmethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane which has 2–12 siloxane units per molecule and contains a hydroxyl group bonded to,each Si in its units positioned at the terminals. Any of these may be used alone or in the form of a mixture of two or more kinds.

The fluorine-containing fine resin powder may include, for example, fine powders of homopolymers or copolymers of fluorine-containing monomers such as tetrafluoroethylene, trifluoroethylene, vinylidene fluoride and fluoroethylene, and fine powders of copolymers of any of these monomers and other ethylene monomers. Of these, fine powder of a vinylidene fluoride polymer is particularly preferred in view of its superior performance of preventing magnetic toner particles from adhering to the surfaces of the contact charging member and contact transfer member and the surface of the photosensitive member end of improving release properties.

As an embodiment for the mode of addition of the fluorine-containing fine resin powder described above, a state is preferred that the fluorine-containing fine resin powder is adhered to the toner particle surfaces of the magnetic toner.

The fluorine-containing fine resin powder may preferably have a primary particle diameter of from 0.05 to 1.00 μm, and particularly preferably from 0.10 to 0.50 μm. If the primary particle diameter of the fine powder is less then 0.05 μm, the fine powder tends to get into concaved portions on the surfaces of magnetic toner particles, making it less effective to prevent the developer from adhering to the surfaces of the contact charging member and contact transfer member end the surface of the photosensitive member and to provide release properties. If it is more than 1.00 μm, the fluorine-containing fine resin powder tends to drop off from the toner particle surfaces, similarly undersirably making it less effective to prevent adhesion of the developer and to provide release properties. As a method for measuring the primary particle diameter of the fluorine-containing fine resin powder, the fluorine-containing fine resin powder was photographed in 20,000 magnifications, and diameters of 30 particles or more of primary particles were measured on the photograph, and its average value was calculated to determine the primary particle diameter.

In the developer of the present invention, the fluorine-containing fine resin powder can be effective when it is applied in an amount of from 0.01 to 1% by weight based on the weight of the magnetic toner, and, in particular, can be well effective when added in an amount of from 0.05 to 0.8% by weight. The fluorine-containing fine resin powder may also preferably be added in an amount smaller than the amount of the fine silica powder used in the present invention.

Here, addition of the fine silica powder in an amount less than 0.01% by weight based on the weight of the magnetic toner may make it less effective to prevent the developer from adhering to the surfaces of the contact charging member and contact transfer member and the surface of the photosensitive member and to provide release properties. On the other hand, its addition in an amount more than 1% by weight is not preferable since it tends to cause fog in images in the developing means. Addition of the fluorine-containing fine resin powder in an amount larger than the amount of the fine silica powder used in the present invention is also not preferable since it may bring about a lowering of the abrasive power of the developer, making it not well effective to prevent paper dust produced from the transfer medium, from adhering to and remaining on the contact charging member, contact transfer member and photosensitive member.

The metal oxide powder used in the present invention may include oxides of magnesium, zinc, cerium, aluminum, cobalt, iron, zirconium, manganese, chromium, strontium, etc., and compound metal oxides such as calcium titanate, magnesium titanate, strontium titanate and barium titanate. In particular, zinc oxide, cerium oxide, aluminum oxide and strontium titanate are preferred, and strontium titanate is particularly preferred.

The metal oxide powder may preferably have in its particle size distribution a weight average particle diameter ($D_4$) of from 0.5 to 5 μm, a number average particle diameter ($D_1$) of from 0.5 to 4 μm, and a $D_4/D_1$ ratio of from 1.0 to 2.4.

As an embodiment for the mode of addition of the metal oxide powder described above, a state is preferred that the metal oxide powder stands separate from the toner particle surfaces of the magnetic toner and is present between toner particles, Since the developer of the present invention contains the metal oxide powder, even when the toner particles adhere to the surfaces of the contact charging member and contact transfer member and the surface of the photosensitive member, the positions at which the toner particles adhere are always changed within the contact charging member, the contact transfer member or the photosensitive member, or therebetween, by interposition of the metal oxide powder and a very small frictional force due to a slight rub occurring between the photosensitive member and each of the contact charging member and the contact transfer member,and the toner particles by no means stays at the same position. Hence, the toner particles do not come to stick fast thereon. The developer has such performance. It also has the performance that, because of its abrasive power, the cleaning performance for the toner particles having adhered to the surfaces of the contact charging member and contact transfer member can be well improved when cleaning members are brought into contact with the contact charging member and the contact transfer member.

In the present invention, if a metal oxide powder having $D_4$ larger than 5 μm is used, the metal oxide powder tends not to participate in development together with the magnetic toner particles at the time of development by the developer, and is gradually accumulated in the developing assembly without being consumed, so that image density is liable to decrease. A metal oxide powder with $D_4$ smaller than 0.5 μm is not preferable since the quantity of the metal oxide powder slipping through may excessively increase in the cleaning means brought into contact with the magnetic material, to tend to result in its accumulation on the surfaces of the contact charging member and contact transfer member. A metal oxide powder with a $D_4/D_1$ ratio larger than 2.4 is not preferable since its particle size distribution becomes so excessively broad that it may contain excessively fine particles and excessively coarse particles in large quantities.

In the developer of the present invention, the metal oxide powder can be effective when it is applied in an amount of from 0.1 to 4% by weight, and, in particular, can be well effective when added in an amount of from 0.2 to 2.5% by weight.

Addition of the metal oxide powder in an amount less than 0.1% by weight based on the weight of the magnetic toner may make it less effective to prevent the developer from adhering to the surfaces of the contact charging member and contact transfer member and the surface of the photosensitive member or may cause a lowering of cleaning performance for toner particles. Its addition in an amount more than 4% by weight is not preferable since the quantity of the metal oxide powder slipping through may excessively increase in the cleaning means brought into contact with the magnetic material, to tend to result in its accumulation on the surfaces of the contact charging member and contact transfer member.

Measurement of toner particle size distribution

The particle size distribution can be measured by various methods. In the present invention, it is measured using Multisizer of a Coulter counter.

A Coulter counter Multisizer Type II (manufactured by Coulter Electronics, Inc.) is used as a measuring device. An interface (manufactured by Nikkaki k.k.) that outputs number distribution and volume distribution and a personal computer CX-1 (manufactured by Canon Inc.) are connected. As an electrolytic solution, an aqueous 1% NaCl solution is prepared using highest-grade or first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Measurement is made by means of the above Coulter counter Multisizer Type II, using an aperture of 100 μm as its aperture when the particle diameter of toner is measured, and using an aperture of 13 μm when the particle diameter of inorganic fine powder is measured. The volume and number of toner and metal oxide powder each are measured and its volume-base distribution and number-base distribution are calculated. Then the weight average particle diameter on the basis of weight, measured from the volume distribution according to the present invention, is determined.

A specific example of the image forming apparatus that can be used in the present invention to carry out the image forming method will be described with reference to FIG. 1.

Reference numeral 1 denotes a rotating drum type photosensitive member serving as the electrostatic image bearing member. The photosensitive member 1 is formed of layers basically comprised of a conductive substrate layer 1*b* made of aluminum or the like and a photoconductive layer 1*a* formed on its periphery. The surface layer of the photoconductive layer 1*a* is comprised of a charge transport material and a polycarbonate resin containing 8% by weight of fluorine-containing fine resin particles. The photosensitive member is clockwise rotated as viewed in the drawing, at a peripheral speed of 200 mm/s.

Reference numeral 2 denotes a charging roller serving as the contact charging means, which is basically comprised of a mandrel at the center and a conductive elastic layer 2*a* formed, on its periphery, of epichlorohydrin rubber containing carbon black. The charging roller 2 is brought into pressure contact with the surface of the photosensitive member 1 at a pressure of 40 g/cm as linear pressure, and is rotated following the rotation of the photosensitive member 1. A felt pad as a cleaning member 12 is also brought into contact with the charging roller 2.

Reference numeral 3 denotes a charging bias power source through which a voltage is applied to the charging roller 2. Application of a bias of DC 1.4 kV to the charging roller 2 causes the surface of the photosensitive member 1 to be charged to a polarity and potential of about −700 V.

Image exposure 4 subsequently carried out as the latent image forming means gives formation of electrostatic latent images. The electrostatic latent images are developed by a developer held in a developing means 5 and successively converted into visible images as toner images. Reference numeral 6 denotes a transfer roller serving as the contact transfer member, which is basically comprised of a mandrel 6*b* at the center and a conductive elastic layer 6*a* formed, on its periphery, of an ethylene/propylene/butadiene copolymer containing carbon black.

The transfer roller 6 is brought into pressure contact with the surface of the photosensitive member 1 at a pressure of 20 g/cm as linear pressure, and is rotated at a speed equal to the peripheral speed of the photosensitive member 1. A felt pad as a cleaning member 13 is also brought into contact with the transfer roller 6.

A4-size paper is used as a transfer medium 8, which is transported between the photosensitive member 1 and the transfer roller 6 and at the same time a bias of DC −5 kV with a polarity reverse to that of the toner is applied from a transfer bias power source 7, so that the toner image on the photosensitive member 1 is transferred to the surface of the transfer medium 8. Thus, in the course of transfer, the transfer roller 6 is brought into contact with the photosensitive member 1 interposing the transfer medium 8 between them.

Subsequently, the transfer medium 8 is transported to a fixing assembly 11 serving as the fixing means, basically comprised of a heating roller 11*a* internally provided with a halogen heater and an elastic-material pressure roller 11*b* brought into pressure contact with it at a given pressure, and is passed between the fixing roller 11*a* and the pressure roller 11*b*, so that the toner image is fixed to the transfer medium 8 and the fixed image is outputted as an image-formed article.

From the surface of the photosensitive member 1 from which the toner image has been transferred, adhered contaminants such as untransferred remaining toner are removed to make the surface clean by means of a cleaning assembly 9 provided with an elastic cleaning blade basically made of polyurethane rubber, counter-clockwise brought into pressure contact with the photosensitive member 1 at a pressure of 25 g/cm as linear pressure. The surface is then subjected to charge elimination through a charge elimination exposure assembly 10, and is repeatedly used for image formation.

The image forming apparatus may be constituted of a combination of plural components joined as one apparatus unit consisting of some of the constituents such as the above electrostatic image bearing member, developing means and cleaning means so that the apparatus unit can be freely mounted on or detached from the body of the apparatus. For example, one selected from the group consisting of the charging means, the developing means and the cleaning means may be held into one unit together with the electrostatic image bearing member so that the unit, as an apparatus unit detachable from the body of the apparatus, can be freely mounted or detached using a guide means such as a rail provided in the body of the apparatus. Here, the apparatus unit may also be so constituted as to hold the constituent(s) not selected from the above group, e.g., the charging means and/or the developing means.

Figure 2:
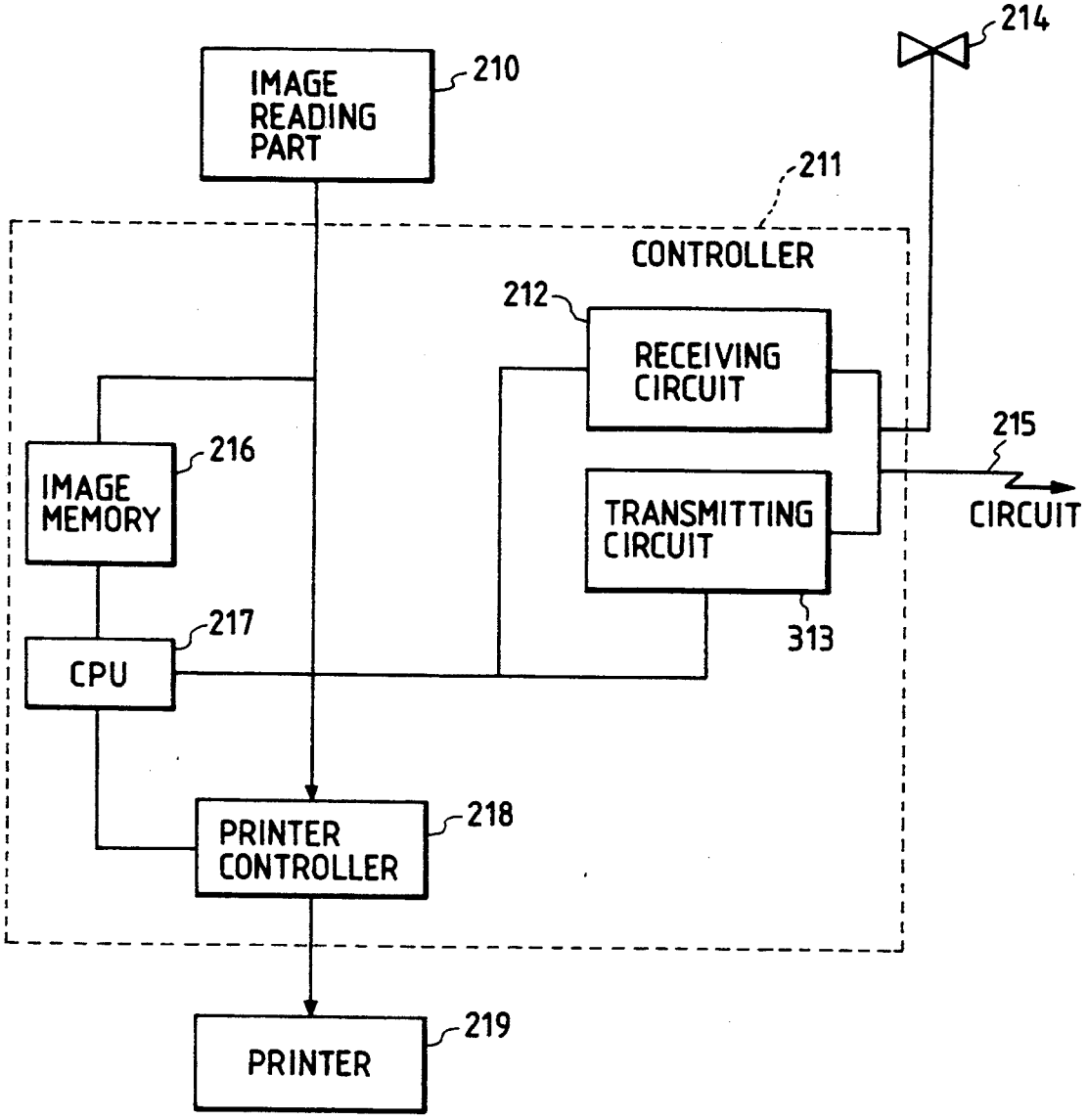
FIG. 2 is a block diagram of a facsimile apparatus in which the image forming apparatus of the present invention is used as a printer.
Figure 4:
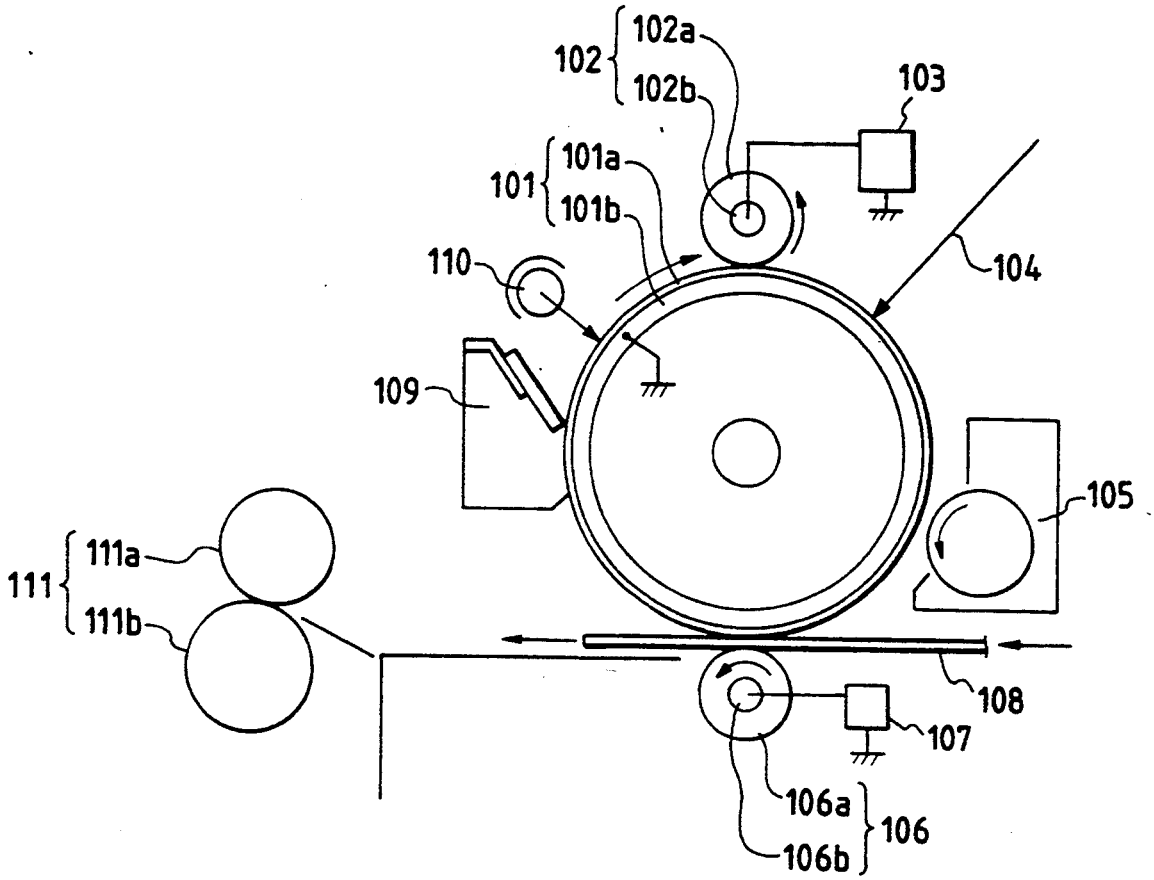
FIG. 4 is a schematic structural view of an image forming apparatus employing the contact charging system and contact transfer system conventionally known in the art.

When the image forming apparatus of the present invention is used as a printer of a facsimile machine, the imagewise exposure 4 serving as the latent image forming means is digital exposure applied using laser beam for the printing of received data. FIG. 2 illustrates an example thereof in the form of a block diagram.

A controller 211 controls an image reading part 210 and a printer 219. The whole of the controller 211 is controlled by CPU 217. Image data outputted from the image reading part is sent to the partner communication station through a transmitting circuit 213. The data received from the partner communication is sent to a printer 219 through a receiving circuit 212. Given image data are stored in an image memory 216. A printer controller 218 controls the printer 219. The numeral 214 denotes a telephone.

The image received from a circuit 215 (image information from a remote terminal connected through the circuit) is demodulated in the receiving circuit 212, and then successively stored in an image memory 216 after the image information is decoded by the CPU 217. Then, when images for at least one page have been stored in the memory 216, the image recording for that page is carried out. The CPU 217 reads out the image information for one page from the memory 216 and sends the decoded image information for one page to the printer controller 218. On receiving the image information for one page from the CPU 217, the printer controller 218 controls the printer 219 to record the image information for one page.

The CPU 217 receives image information for next page in the course of the recording by the printer 219.

According to the present invention, the developer is comprised of the magnetic toner having the specific binder resin component and low-molecular weight wax and the external additives of the fine silica powder, metal oxide powder and fluorine-containing fine resin powder which are used in combination in given amounts. Hence, it is possible to prevent the melt-adhesion of toner to the surfaces of the contact charging member and contact transfer member, to cause no faulty images and to obtain images with the enjoyment of superior low-temperature fixing performance and anti-offset properties, even when copies are taken on a large number of sheets using the image forming method having contact charging and contact transfer systems.

The basic construction and features of the present invention have been described above. The present invention will be described below in greater detail by giving Examples. It, however, should be noted that these by no means limit the present invention. In the following formulation, "part(s)" refers to "part(s) by weight".

Resin Synthesis Example 1

Into a four-neck flask equipped with a nitrogen gas feed pipe, a capacitor, a stirrer and a thermometer, 800 parts of xylene was charged, and was stirred in a stream of nitrogen gas. The temperature was raised and kept at 90° C., and a mixture of 84 parts of styrene, 16 parts of n-butyl acrylate and 4 parts of di-t-butyl peroxide (DTBP) as an initiator was dropwise added over a period of 6 hours using a continuous dropping device to carry out polymerization, followed by removing the solvent to give polymer A. The molecular weight distribution of the polymer A was measured by GPC to reveal that it had a peak value at a molecular weight of 11,500 and a value of Mw/Mn of 2.4.

Resin Synthesis Example 2

Into the polymerizing apparatus described above, a mixture of 86 parts of styrene, 14 parts of butadiene and 2.5 parts of benzoyl peroxide (BPO) as an initiator in 300 parts of an aqueous 0.1% polyvinyl alcohol solution was charged, and polymerization was carried out at a polymerization temperature of 90° C. for 24 hours. Thereafter, the product was cooled, washed with water and dried to give polymer B. The molecular weight distribution of the polymer C was measured by GPC to reveal that it had a peak value at a molecular weight of 20,900 and a value of Mw/Mn of 10.5.

Resin Synthesis Example 3

Into the polymerizing apparatus of Resin Synthesis Example 1, a mixture of 86 parts of styrene, 14 parts of n-butyl acrylate and 0.4 part of 1,4-bis(t-butylperoxy)-cyclohexane (HTP) as an initiator in 300 parts of an aqueous 0.1% polyvinyl alcohol solution was charged, and polymerization was carried out at a polymerization temperature of 90° C. for 24 hours. Thereafter, the product was cooled, washed with water and dried to give polymer C. The molecular weight distribution of the polymer C was measured by GPC to reveal that it had a peak value at a molecular weight of 690,000 and a value of Mw/Mn of 10.4.

Magnetic Toner Production Example 1

Using a blender, 56 parts of the polymer A, 20 parts of the polymer B, 24 parts of the polymer C, 4 parts of a low-molecular weight polypropylene (Mw: about 10,000), 80 parts of triiron tetraoxide (average particle diameter: 0.2 μm) and 2 parts of Nigrosine were thoroughly mixed.

Thereafter, the mixture was melt-kneaded using a twin-screw kneading extruder set at 120° C. The resulting kneaded product was cooled and then crushed using a cutter mill, and thereafter the crushed product was finely pulverized using a fine grinding mill utilizing a jet stream. The resulting finely pulverized product was classified using a multi-division classifier utilizing the Coanda effect, to give magnetic toner (1) with a weight average particle diameter ($D_4$) of 8.5 μm.

The molecular weight distribution of the binder resin component of the magnetic toner (1) was measured by GPC under conditions shown below.

GPC measurement conditions

Apparatus:

LC-GPC 150C {Waters Co.)

Columns: Shodex KF-801, 802, 803, 804, 805, 806 and 807, KF-800) (Showa Denko K.K.)

Temperature: 40° C.
Solvent: Tetrahydrofuran (THF)
Flow rate: 1.0 ml/min.
Sample: 0.1 ml of a solution sample with a sample concentration of 3 to 7 mg/ml (THF) was injected.

Figure 3:
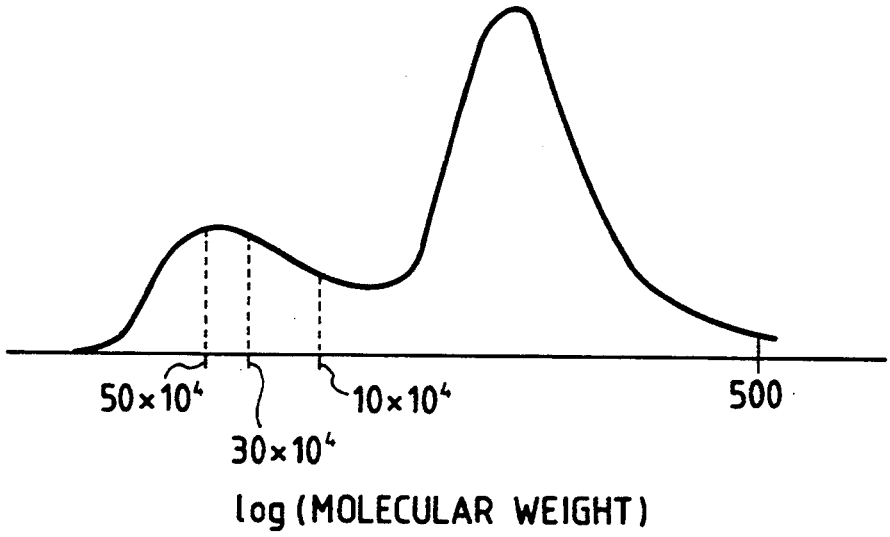
FIG. 3 shows a chromatogram of GPC.

As a result, the low-molecular weight component in the low-molecular weight region of a molecular weight of from 500 to less than 100,000 was in 75% by weight, the medium-molecular weight component in the medium-molecular weight region of a molecular weight of from 100,000 to less than 300,000 was in 9.5% by weight and the high-molecular weight component in the high-molecular weight region of a molecular weight of not less than 500,000 was in 10.6% by weight. A GPC chromatogram thereof is shown in FIG. 3.

Magnetic Toner Production Example 2

Magnetic toner (2) was obtained in the same manner as in Magnetic Toner Production Example 1 except that the polymers A, B and C used therein were used in amounts of 32 parts, 20 parts and 48 parts, respectively. The ($D_4$) of this toner was 8.9 μm, The molecular weight distribution of its binder resin component was that the low-molecular weight component in the low-molecular weight region of a molecular weight of from 500 to less than 100,000 was in 45% by weight, the medium-molecular weight component in the medium-molecular weight region of a molecular weight of from 100,000 to less than 300,000 was in 21% by weight and the high-molecular weight component in the high-molecular weight region of a molecular weight of not less than 500,000 was in 35% by weight.

Magnetic Toner Production Example 3

Magnetic toner (3) was obtained in the same manner as in Magnetic Toner Production Example 1 except that the polymers A, B and C used therein were used in amounts of 90 parts, 3 parts and 7 parts, respectively. The ($D_4$) of this toner was 8.0 μm. The molecular weight distribution of its binder resin component was that the low-molecular weight component in the low-molecular weight region of a molecular weight of from 500 to less than 100,000 was in 92% by weight, the medium-molecular weight component in the medium-molecular weight :region of a molecular weight of from 100,000 to less than 300,000 was in 5% by weight and the high-molecular weight component in the high-molecular weight region of a molecular weight of not less than 500,000 was in 4% by weight.

EXAMPLE 1

To 100 parts of the magnetic toner (1), 0.6 part of positively chargeable hydrophobic dry-process silica (BET specific surface area: 130 $m^2/g$) as the fine silica powder, 0.2 part of fine powder of vinylidene fluoride polymer (primary particle diameter: 0.30 μm) as the fluorine-containing fine resin powder and 1.0 part of strontium titanate powder ($D_1$: 1.1 μm.; $D_4$: 1.9 μm; $D_4/D_1$: 1.7) as the metal oxide powder were added, followed by mixing using; a Henschel mixer to give a positively chargeable developer.

In the image forming apparatus shown in FIG. 1, this developer was applied to carry out running for continuous 20,000 sheet copying. As a result, neither melt-adhesion of toner nor contamination by paper dust were seen on the charging roller and the transfer roller after the running, neither faulty charging nor faulty transfer occurred, the surface of the photosensitive member was similarly in a good state, and the images obtained were all good.

The fixing assembly of the image forming apparatus was removed, and unfixed images were produced on transfer paper. Meanwhile, a fixing assembly detached from an electrophotographic copying machine GP55 (manufactured by Canon Inc.) was modified into a temperature-variable, heat-roller type external fixing assembly, and the unfixed images were fixed using this fixing assembly to make a fixing test and an offset test.

The nip of the external fixing assembly was set at 5.0 mm and the fixing speed thereof at 200 mm/sec. Its temperature was controlled at intervals of 5° C. within the temperature range of from 150° C. to 255° C., and the unfixed images were fixed at each temperature. The fixed images obtained were rubbed with Silbon paper under a load of 50 $g/cm^2$. A fixing temperature at which the image density before rubbing decreased by 5% or less after rubbing was regarded as a fixing initiation temperature.

As a result, the fixing initiation temperature was as low as 170° C., showing a superior low-temperature fixing performance. Offset began to occur at a temperature (offsetting temperature) of as high as 250° C., showing a superior anti-offset performance.

Results of the above are shown in Table 1.

Comparative Example 1

A developer was prepared and evaluated in the same manner as in Example 1 except that the fine powder of vinylidene fluoride polymer and strontium titanate powder used were not used. As a result, fixing performance and anti-offset performance were as good as Example 1. In the images after the running, black dots appeared on the whole surfaces and uneven image density was seen. Moreover, upon observation of the surfaces of the fixing roller, transfer roller and photosensitive member, the toner was seen to have adhered to the whole surfaces of all the members.

Results obtained are shown in Table 2.

Comparative Example 2

A developer was prepared in the same manner as in Example 1 except that the fine powder of vinylidene fluoride polymer was not used. Evaluation was made in the same manner as in Example 1.

Results obtained are shown in Table 2.

Comparative Example 3

A developer was prepared in the same manner as in Example 1 except that the strontium titanate powder was not used. Evaluation was made in the same manner as in Example 1.

Results obtained are shown in Table 2.

Comparative Example 4

A developer was prepared in the same manner as in Example 1 except that the amounts of the positively chargeable hydrophobic dry-process silica and fine powder of vinylidene fluoride polymer were changed to 0.4 part and 0.5 part, respectively. Evaluation was made in the same manner as in Example 1.

As a result, although the toner itself was not seen to have adhered to the surfaces of the fixing roller, transfer roller and photosensitive member, contamination by paper dust had occurred on these surfaces, and uneven density was seen on the images obtained.

Results obtained are shown in Table 2.

Comparative Example 5

A developer was prepared in the same manner as in Example 1 except that the positively chargeable hydrophobic dry-process silica powder was not used. Evaluation was made in the same manner as in Example 1.

Results obtained are shown in Table 2.

EXAMPLE 2

A developer was prepared in the same manner as in Example 1 except that the fine powder of vinylidene fluoride polymer with a primary particle diameter of 0.30 μm was replaced with fine powder of vinylidene fluoride polymer having a primary particle diameter of 0.09 μm. Evaluation was made in the same manner as in Example 1.

Results obtained are shown in Table 1.

EXAMPLE 3

A developer was prepared in the same manner as in Example 1 except that the fine powder of vinylidene fluoride polymer with a primary particle diameter of 0.30 μm was replaced with fine powder of vinylidene fluoride polymer having a primary particle diameter of 0.92 μm. Evaluation was made in the same manner as in Example 1.

Results obtained are shown in Table 1.

EXAMPLE 4

A developer was prepared in the same manner as in Example 1 except that the strontiumtitanate powder of $D_1$:1.1 μm, $D_4$:1.9 μm and $D_4/D_1$: 1.7 was replaced with strontium titanate powder of $D_1$:0.8 μm, $D_4$:1.0 μm and $D_4/D_1$:1.3. Evaluation was made in the same manner as in Example 1.

Results obtained are shown in Table 1.

EXAMPLE 5

A developer was prepared in the same manner as in Example 1 except that the strontium titanate powder of $D_1$:1.1 μm, $D_4$:1.9 μm and $D_4/D_1$:1.7 was replaced with strontium titanate powder of $D_1$:3.0 μm, $D_4$:5.9 μm and $D_4/D_1$:3.0. Evaluation was made in the same manner as in Example 1.

Results obtained are shown in Table 1.

EXAMPLE 6

A developer was prepared in the same manner as in Example 1 except that the amounts of the positively chargeable hydrophobic dry-process silica and strontium titanate powder were changed to 1.5 parts and 3.5 parts, respectively. Evaluation was made in the same manner as in Example 1.

Results obtained are shown in Table 1.

EXAMPLE 7

A developer was prepared in the same manner as in Example 1 except that the amounts of the positively chargeable hydrophobic dry-process silica and strontium titanate powder were changed to 0.2 part and 0.3 part, respectively. Evaluation was made in the same manner as in Example 1.

Results obtained are shown in Table 1.

EXAMPLE 8

A developer was prepared in the same manner as in Example 1 except that the amounts of the positively chargeable hydrophobic dry-process silica and fine powder of vinylidene fluoride polymer used therein were changed to 1.2 parts and 0.9 part, respectively. Evaluation was made in the same manner as in Example 1.

Results obtained are shown in Table 1.

EXAMPLE 9

A developer was prepared in the same manner as in Example 1 except that the amounts of the positively chargeable hydrophobic dry-process silica and fine powder of vinylidene fluoride polymer used therein were changed to 0.4 part and 0.05 part, respectively. Evaluation was made in the same manner as in Example 1.

Results obtained are shown in Table 1.

Comparative Example 6

A developer was prepared in the same manner as in Example 1 except that the amount of the positively chargeable hydrophobic dry-process silica was changed to 2.5 parts. Evaluation was made in the same manner as in Example 1.

Results obtained are shown in Table 2.

Comparative Example 7

A developer was prepared in the same manner as in Example 1 except that the amount of the strontium titanate powder was changed to 5.0 parts. Evaluation was made in the same manner as in Example 1.

Results obtained are shown in Table 2.

Comparative Example 8

A developer was prepared in the same manner as in Example 1 except that the amount of the fine powder of vinylidene fluoride polymer was changed to 1.6 parts. Evaluation was made in the same manner as in Example 1.

Results obtained are shown in Table 2.

Comparative Example 9

A developer was prepared in the same manner as in Example 1 except that the magnetic toner (1) Was replaced with the magnetic toner (2). Evaluation was made in the same manner as in Example 1. Although image characteristics after 20,000 sheet running were good, the fixing initiation temperature was as high as 195° C., showing a poor low-temperature fixing performance.

Results obtained are shown in Table 2.

Comparative Example 10

A developer was prepared in the same manner as in Example 1 except that the magnetic toner (1) was replaced with the magnetic toner (3). Evaluation was made in the same manner as in Example 1. Although image characteristics after 20,000 sheet running were good, the offsetting temperature was as low as 220° C.

Results obtained are shown in Table 2.

TABLE 1

| Example: | Fine silica powder Awt. % | Metal oxide powder Bwt. % | $D_1$ (μm) | $D_4$ (μm) | $D_4/D_1$ | Fluorine-containing resin powder Cwt. % | Primary particle diameter (μm) | Image characteristics after 20,000 sheet running | State of surface of each member after 20,000 sheet running (1) | (2) | (3) | Fixing initiation temp. (°C.) | Offsetting temp. (°C.) |
|---|---|---|---|---|---|---|---|---|---|---|---|---|---|
| 1 | 0.6 | 1.0 | 1.1 | 1.9 | 1.7 | 0.2 | 0.30 | A | A | A | A | 170 | 250 |
| 2 | 0.6 | 1.0 | 1.1 | 1.9 | 1.7 | 0.2 | 0.09 | AB | B | AB | AB | 170 | 250 |
| 3 | 0.6 | 1.0 | 1.1 | 1.9 | 1.7 | 0.2 | 0.92 | AB | B | AB | A | 170 | 250 |
| 4 | 0.6 | 1.0 | 0.8 | 1.0 | 1.3 | 0.2 | 0.30 | AB | B | B | A | 170 | 250 |
| 5 | 0.6 | 1.0 | 3.0 | 5.9 | 3.0 | 0.2 | 0.30 | AB*1 | AB | AB | A | 170 | 250 |
| 6 | 1.5 | 3.5 | 1.1 | 1.9 | 1.7 | 0.2 | 0.30 | AB | B | AB | A | 170 | 250 |
| 7 | 0.2 | 0.3 | 1.1 | 1.9 | 1.7 | 0.2 | 0.30 | A | AB | A | A | 170 | 250 |
| 8 | 1.2 | 1.0 | 1.1 | 1.9 | 1.7 | 0.9 | 0.30 | AB | B | AB | A | 170 | 250 |
| 9 | 0.4 | 1.0 | 1.1 | 1.9 | 1.7 | 0.05 | 0.30 | AB | AB | AB | AB | 170 | 250 |

(1): Charging roller, (2): Transfer roller, (3): Photosensitive member
*1A slight decrease in image density occurred.
Image characteristics after 20,000 sheet running:
A: No black dots and uneven image density were seen at all.
AB: Black dots and uneven image density were little seen.
B: Black dots and uneven image density were a little seen.
BC: Black dots and uneven image density were partly seen.
C: Black dots and uneven image density were seen over the whole.
State of surface of each member after 20,000 sheet running:
A: No toner adhesion and contamination were seen at all.
AB: Toner adhesion and contamination were little seen.
B: Toner adhesion and contamination were a little seen.
BC: Toner adhesion and contamination were partly seen.
C: Toner adhesion and contamination were seen over the whole.

TABLE 2

| Comparative Example: | Fine silica powder Awt. % | Metal oxide powder Bwt. % | $D_1$ (μm) | $D_4$ (μm) | $D_4/D_1$ | Fluorine-containing resin powder Cwt. % | Primary particle diameter (μm) | Image characteristics after 20,000 sheet running | State of surface of each member after 20,000 sheet running (1) | (2) | (3) | Fixing initiation temp. (°C.) | Offsetting temp. (°C.) |
|---|---|---|---|---|---|---|---|---|---|---|---|---|---|
| 1 | 0.6 | 0.0 | — | — | — | 0.0 | — | C | C | C | C | 170 | 250 |
| 2 | 0.6 | 1.0 | 1.1 | 1.9 | 1.7 | 0.0 | — | BC | C | BC | BC | 170 | 250 |
| 3 | 0.6 | 0.0 | — | — | — | 0.2 | 0.30 | BC | BC | BC | BC | 170 | 250 |
| 4 | 0.4 | 0.0 | 1.1 | 1.9 | 1.7 | 0.5 | 0.30 | BC | BC | BC | AB | 170 | 250 |
| 5 | 0.0 | 1.0 | 1.1 | 1.9 | 1.7 | 0.2 | 0.30 | BC | BC | BC | B | 170 | 250 |
| 6 | 2.5 | 1.0 | 1.1 | 1.9 | 1.7 | 0.2 | 0.30 | C | C | C | A | 170 | 250 |
| 7 | 0.6 | 5.0 | 1.1 | 1.9 | 1.7 | 0.2 | 0.30 | C | C | C | A | 170 | 250 |
| 8 | 0.6 | 1.0 | 1.1 | 1.9 | 1.7 | 1.6 | 0.30 | C*2 | C | C | A | 170 | 250 |
| 9 | 0.6 | 1.0 | 1.1 | 1.9 | 1.7 | 0.2 | 0.30 | A | A | A | A | 195 | 255 |
| 10 | 0.6 | 1.0 | 1.1 | 1.9 | 1.7 | 0.2 | 0.30 | A | A | A | A | 165 | 220 |

(1): Charging roller, (2): Transfer roller, (3): Photosensitive member
*2Particularly serious fog occurred.
Image characteristics after 20,000 sheet running:
A: No black dots and uneven image density were seen at all.
AB: Black dots and uneven image density were little seen.
B: Black dots and uneven image density were a little seen.
BC: Black dots and uneven image density were partly seen.
C: Black dots and uneven image density were seen over the whole.
State of surface of each member after 20,000 sheet running:
A: No toner adhesion and contamination were seen at all.
AB: Toner adhesion and contamination were little seen.
B: Toner adhesion and contamination were a little seen.
BC: Toner adhesion and contamination were partly seen.
C: Toner adhesion and contamination were seen over the whole.

What is claimed is:

1. A developer for developing an electrostatic image, comprising i) a magnetic toner containing at least, 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,000, not more than 20% by weight of a medium-molecular weight component in the medium-molecular weight region of a molecular weight of not less than 100,000 to less than 300,000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder.

2. A developer according to claim 1, wherein said binder resin component is prepared using i) a low-molecular weight polymer having, in a chromatogram of GPC, a peak value of molecular weight in the molecular weight region of 5,000 to 60,000 and a value of weight average molecular weight (Mw)/number average molecular weight (Mn) of not more than 15 and ii) a high-molecular weight polymer or/and a cross-linked polymer having a peak value of molecular weight in the molecular weight region of 300,000 to 1,000,000 and a value of weight average molecular weight (Mw)/number average molecular weight (Mn) of not more than 40.

3. A developer according to claim 2, wherein said binder resin component is prepared by melt-kneading a binder resin obtained by dissolving or swelling i) a low-molecular weight polymer having, in a chromatogram of GPC, a peak value of molecular weight in the molecular weight region of 5,000 to 60,000 and a value of weight average molecular weight (Mw)/number average molecular weight (Mn) of not more than 15 and ii) a high-molecular weight polymer or/and a cross-linked polymer having a peak value of molecular weight in the molecular weight region of 300,000 to 1,000,000 and a value of weight average molecular weight (Mw)/number average molecular weight (Mn) of not more than 40, in a solvent capable of dissolving or swelling said low-molecular weight polymer and said high-molecular weight polymer or cross-linked polymer, to mix them, followed by removal of the solvent.

4. A developer according to claim 1, wherein said binder resin component is prepared by melt-kneading i) a low-molecular weight polymer having, in a chromatogram of GPC, a peak value of molecular weight in the molecular weight region of 5,000 to 60,000 and a value of weight average molecular weight (Mw)/number average molecular weight (Mn) of not more than 15 and ii) a high-molecular weight polymer or/and a cross-linked polymer having a peak value of molecular weight in the molecular weight region of 300,000 to 1,000,000 and a value of weight average molecular weight (Mw)/number average molecular weight (Mn) of not more than 40.

5. A developer according to claim 2, wherein said low-molecular weight polymer is prepared by solution polymerization or emulsion polymerization using a radical polymerization initiator, said high-molecular weight polymer is prepared by suspension polymerization using a bifunctional radical polymerization initiator, and said cross-linked polymer is prepared by suspension polymerization using a cross-linkable monomer.

6. A developer according to claim 5, wherein said radical polymerization initiator is used in an amount of from 0.1% by weight to 15% by weight based on the weight of monomers constituting the low-molecular weight polymer.

7. A developer according to claim 5, wherein said radical polymerization initiator is used in an amount of from 1% by weight to 10% by weight based on the weight of monomers constituting the low-molecular weight polymer.

8. A developer according to claim 5, wherein said bifunctional radical polymerization initiator is used in an amount of from 0.05% by weight to 5% by weight based on the weight of monomers constituting the high-molecular weight polymer.

9. A developer according to claim 5, wherein said bifunctional radical polymerization initiator is used in an amount of from 0.1% by weight to 3% by weight based on the weight of monomers constituting the high-molecular weight polymer.

10. A developer according to claim 5, wherein said cross-linkable monomer is used in an amount of from 0.01% by weight to 5% by weight based on the weight of other monomers constituting the cross-linked polymer.

11. A developer according to claim 5, wherein said cross-linkable monomer is used in an amount of from 0.03% by weight to 3% by weight based on the weight of other monomers constituting the cross-linked polymer.

12. A developer according to claim 1, wherein said binder resin component comprises a vinyl resin.

13. A developer according to claim 1, wherein said binder resin component comprises a styrene polymer or a styrene copolymer.

14. A developer according to claim 1, wherein said low-molecular weight wax component comprises,an aliphatic hydrocarbon wax, an oxide of an aliphatic hydrocarbon wax, or a block copolymer of these, or a wax mainly composed of a fatty acid ester, or a wax obtained by deoxidizing partly or wholly a fatty acid ester.

15. A developer according to claim 1, wherein said low-molecular weight wax component comprises an aliphatic hydrocarbon wax.

16. A developer according to claim 1, wherein said low-molecular weight wax component is contained in the magnetic toner in an amount of from 0.1 part by weight to 20 parts by weight based on 100 parts by weight of the binder resin component.

17. A developer according to claim 1, wherein said low-molecular weight wax component is contained in the magnetic toner in an amount of from 0.5 part by weight to 10 parts by weight based on 100 parts by weight of the binder resin component.

18. A developer according to claim 1, wherein said magnetic toner contains a magnetic material in an amount of from 50 parts by weight to 120 parts by weight based on 100 parts by weight of the binder resin component.

19. A developer according to claim 1, wherein said magnetic toner contains a magnetic material in an amount of from 65 parts by weight to 100 parts by weight based on 100 parts by weight of the binder resin component.

20. A developer according to claim 1, wherein said fine silica powder has a BET specific surface area of 30 $m^2/g$ or more.

21. A developer according to claim 1, wherein said fine silica powder has a BET specific surface area of from 50 $m^2/g$ to 400 $m^2/g$.

22. A developer according to claim 1, wherein said magnetic toner comprises a positively chargeable magnetic toner and said fine silica powder comprises a positively chargeable fine silica powder.

23. A developer according to claim 22, wherein said fine silica powder comprises a fine silica powder having been treated with a silicone oil having an organo group having at least one nitrogen atom in the side chain.

24. A developer according to claim 22, wherein said fine silica powder comprises a fine silica powder having been treated with a nitrogen-containing silane coupling agent.

25. A developer according to claim 22, wherein said positively chargeable fine silica powder comprises a fine silica powder having been treated with i) a silicone oil having an organo group having at least one nitrogen atom in the side chain and ii) a nitrogen-containing silane coupling agent.

26. A developer according to claim 1, wherein said fine silica powder has been subjected to hydrophobic treatment.

27. A developer according to claim 1, wherein said fine silica powder is contained in an amount of from 0.2% by weight to 1.8% by weight based on the weight of the magnetic toner.

28. A developer according to claim 1, wherein said fluorine-containing fine resin powder comprises tetrafluoroethylene, trifluoroethylene, vinylidene fluoride or fluoroethylene.

29. A developer according to claim 1, wherein said fluorine-containing fine resin powder comprises vinylidene fluoride.

30. A developer according to claim 1, wherein said fluorine-containing fine resin powder has a primary particle diameter of from 0.05 μm to 1.00 μm.

31. A developer according to claim 1, wherein said fluorine-containing fine resin powder has a primary particle diameter of from 0.10 μm to 0.50 μm.

32. A developer according to claim 1, wherein said fluorine-containing fine resin powder is contained in an amount of from 0.05% by weight to 0.8% by weight based on the weight of the magnetic toner.

33. A developer according to claim 1, wherein said metal oxide powder comprises zinc oxide, cerium oxide, aluminum oxide or strontium titanate.

34. A developer according to claim 1, wherein said metal oxide powder has a particle size distribution of a weight average particle diameter $D_4$ of from 0.5 μm to 5 μm, a number average particle diameter $D_1$ of from 0.5 μm to 4 μm and a $D_4/D_1$ ratio of from 1.0 to 2.4.

35. A developer according to claim 1, wherein said metal oxide powder is contained in an amount of from 0.24 by weight to 2.5% by weight based on the weight of the magnetic toner.

36. An image forming method comprising;

bringing a contact charging member into contact with the surface of an electrostatic image bearing member and applying a bias voltage to electrostatically charge said electrostatic image bearing member;

forming an electrostatic image on the electrostatically charged electrostatic image bearing member through a latent image forming means;

developing the electrostatic latent image which said electrostatic image bearing member bears, by the use of a developer; said developer comprising i) a magnetic toner containing 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,000, not more than 20% by weight of a medium-molecular weight component in the medium-molecular weight region of a molecular weight of not less than 100,000 to less than 300,000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder;

transferring a developed image formed by development, to a transfer medium by means of a contact transfer member brought into contact with the surface of the electrostatic image bearing member interposing the transfer medium between them; and fixing the developed image on the transfer medium through a fixing means.

37. An image forming method comprising:

bringing a contact charging member into contact with the surface of an electrostatic image bearing member and applying a bias voltage to electrostatically charge said electrostatic image bearing member;

forming an electrostatic image on the electrostatically charged electrostatic image bearing member through a latent image forming means;

developing the electrostatic latent image which said electrostatic image bearing member bears, by the use of a developer; said developer comprising i) a magnetic toner containing 100 parts by weight of a binder resin component, from 0.1 part by weight to 20 parts by weight of a low molecular wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,000, not more than 20% by weight of a medium-molecular weight component in the medium-molecular weight region of a molecular weight of not less than 100,00 to less an 300,000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder;

transferring a developed image formed by development, to a transfer medium by means of a control transfer member brought into contact with the surface of the electrostatic image bearing member interposing the transfer medium between them; and fixing the developed image on the transfer medium through a fixing means, wherein said developer comprises a developer selected from those according to claims 2 to 35.

38. An image forming apparatus comprising;

an electrostatic image bearing member capable of bearing an electrostatic latent image;

a contact charging member brought into contact with the surface of said electrostatic image bearing member and capable of electrostatically charging said electrostatic image bearing member upon application of a bias voltage;

a latent image forming means capable of forming an electrostatic latent image on the electrostatically charged electrostatic image bearing member;

a developing means capable of developing the electrostatic latent image which said electrostatic image bearing member bears; said developing means holding a developer; said developer comprising i) a magnetic toner containing 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,000, not more than 20% by weight of a medium-molecular weight component in the medium-molecular weight region of a molecular weight of not less than 100,000 to less than 300;000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder;

a contact transfer member brought into contact with the surface of the electrostatic image bearing member interposing a transfer medium between them, capable of transferring to the transfer medium a developed image formed by the developing means; and a fixing means capable of fixing the developed image on the transfer medium.

39. An image forming apparatus comprising:

an electrostatic image bearing member capable of bearing an electrostatic latent image;

a contact charging member brought into contact with the surface of said electrostatic image bearing member and capable of electrostatically charging said electrostatic image bearing member upon application of a bias voltage;

a latent image forming means capable of forming an electrostatic latent image on the electrostatically charged electrostatic image bearing member;

a developing means capable of developing the electrostatic latent image which said electrostatic image bearing member bears; said developing means holding a developer; said developer comprising i) a magnetic toner containing 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% by weight of a low-molecular weight component in the low-molecular weight region of a molecular weight of not less than 500 to less than 100,00, not more than 20% by weight of a medium-molecular weight component in the medium-molecular weight region of a molecular weight of not less than 100,000 to less then 300,000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of aid fluorine-containing fine resin powder;

a contact transfer member brought into contact with the surface of the electrostatic image bearing member interposing a transfer medium between them, capable of transferring to the transfer medium a developed image formed by the developing means; and a fixing means capable of fixing the developed image on the transfer medium, wherein said developer comprises a developer selected from those according to claims 2 to 35.

40. An apparatus unit detachably mounted in the body of an image forming apparatus, which comprises:

an electrostatic image bearing member capable of bearing an electrostatic latent image, and a developing means capable of developing the electrostatic latent image borne by said electrostatic image bearing member;

said developing means containing a developer which comprises i) a magnetic toner containing 100 parts by weight of a binder resin component, from 0.1 part by weight to 20 parts by weight of a low-molecular weight wax component and from 50 parts by weight to 120 parts by weight of a magnetic material and ii) additives, wherein:

said binder resin component has in a gel permeation chromatogram from 50% by weight to 90% by weight of a low-molecular weight component in the low-molecular weight region of a molecular weight of not less than 500 to less than 100,000, not more than 20% by weight of a medium-molecular weight component in the medium molecular weight region of a molecular weight of not less than 100,000 to less than 300,000 and from 5% by weight to 30% by weight of a high-molecular weight component in the high-molecular weight region of a molecular weight of not less than 500,000, based on THF-soluble matter;

said additives comprising from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being present in an amount greater than the amount of said fluorine-containing fine resin powder.

41. An apparatus unit comprising an electrostatic image bearing member capable of bearing an electrostatic latent image, and a contact charging member brought into contact with the surface of said electrostatic image bearing member and capable of electrostatically charging said electrostatic image bearing member upon application of a bias voltage; at least one of said members being held into one unit together with a developing means capable of developing the electrostatic latent image which said electrostatic image bearing member bears;

said unit being detachably mounted in the body of an apparatus having;

a latent image forming means capable of forming an electrostatic latent image on the electrostatically charged electrostatic image bearing member;

a contact transfer member brought into contact with the surface of the electrostatic image bearing member interposing a transfer medium between them, capable of transferring to the transfer medium a developed image formed by the developing means; and a fixing means capable of fixing the toner image on the transfer medium;

said developing means holding a developer; said developer comprising i) a magnetic toner containing 100 parts by weight of a binder resin component, from 0.1 part by weight to 20 parts by weight of a low-molecular weight wax component and from 50 parts by weight to 120 parts by weight of a magnetic material and ii) additives, wherein;

said binder resin component has, in a chromatogram measured by GPC (gel permeation chromatography), from 50% by weight to 90% weight of a low-molecular weight component in the low-molecular weight region of a molecular weight of not less than 500 to less than 100,000, not more than 20% by weight of a medium-molecular weight component in the medium-molecular weight region of a molecular weight of not less than 100,00 to less than 300,000, and from 5% by weight to 30% by weight of a high-molecular weight component in the high-molecular weight region of a molecular weight of not less than 500,000, based on THF-soluble matter; and said additives comprise from 0.1% by weight to 2% by weight of a fine silica powder, from 0.1% by weight to 4% by weight of a metal oxide powder and from 0.01% by weight to 1% by weight of a fluorine-containing fine resin powder, based on the weight of the magnetic toner; said fine silica powder being in a content larger than the content of said fluorine-containing fine resin powder, wherein said developer comprises a developer selected from those according to claims 2 to 35.

42. An apparatus unit according to claim 40, which comprises at least one of a contact charging member brought into contact with the surface of said electrostatic image bearing member and capable of electrostatically charging said electrostatic image bearing member upon application of a bias voltage, and a cleaning means integrated with said electrostatic image bearing member and said developing means.

* * * * *

UNITED STATES PATENT AND TRADEMARK OFFICE

CERTIFICATE OF CORRECTION

PATENT NO. : 5,406,357

DATED : April 11, 1995

INVENTOR(S) : TOSHIAKI NAKAHARA, ET AL.

It is certified that error appears in the above-identified patent and that said Letters Patent is hereby corrected as shown below:

ON TITLE PAGE

In [56] References Cited, under FOREIGN PATENT DOCUMENTS:
"42-23910 11/1957 Japan
43-24748 10/1958 Japan" should read
--42-23910 11/1967 Japan
43-24748 10/1968 Japan--.

IN THE DRAWINGS

Sheet 2 of 3, "313" should read --213--.

COLUMN 1

Line 20, "sharging" should read --charging--.
Line 27, "transfer" (second occurrence) should read --transferring--.
Line 53, "has began" should read --have begun--.
Line 62, "image:" should read --image--.
Line 64, "more:" should read --more--.

COLUMN 2

Line 13, "2-23385." should read --2-123385.--.
Line 43, "is" should read --it--.

COLUMN 4

Line 9, close up right margin.
Line 10, close up left margin.

UNITED STATES PATENT AND TRADEMARK OFFICE

CERTIFICATE OF CORRECTION

PATENT NO. : 5,406,357

DATED : April 11, 1995

INVENTOR(S) : TOSHIAKI NAKAHARA, ET AL.

It is certified that error appears in the above-identified patent and that said Letters Patent is hereby corrected as shown below:

COLUMN 5

Line 44, "wherein;" should read --wherein:--.
Line 68, "comprising;" should read --comprising:--.

COLUMN 6

Line 11, "containing," should read --containing--.
Line 15, "wherein;" should read --wherein:--.
Line 45, "comprising;" should read --comprising:--.
Line 60, "least," should read --least--.
Line 64, "wherein;" should read --wherein:--.

COLUMN 7

Line 10, "24" should read --2%--.
Line 18, "With" should read --with--.
Line 36, "the:" should read --the--.
Line 37, "having;" should read --having:--.
Line 50, "least," should read --least--.
Line 55, "wherein;" should read --wherein:--.

COLUMN 9

Line 39, "the the" should read --the--.

COLUMN 10

Line 10, "come to be" should read --is--.
Line 14, "come to be" should read --is--.
Line 29, "di-di-t-butyl peroxide," should read --di-t-butyl peroxide,--.
Line 30, "p-menthane" should read --p-methane--.

UNITED STATES PATENT AND TRADEMARK OFFICE

CERTIFICATE OF CORRECTION

PATENT NO. : 5,406,357

DATED : April 11, 1995

INVENTOR(S) : TOSHIAKI NAKAHARA, ET AL.

It is certified that error appears in the above-identified patent and that said Letters Patent is hereby corrected as shown below:

COLUMN 11

Line 16, "dimetylaminoethyl" should read --dimethylaminoethyl--.

COLUMN 12

Line 46, "metal:" should read --metal--.

COLUMN 13

Line 38, "coelescent" should read --coalescent-.
Line 49, "is" should read --as--.

COLUMN 15

Line 57, "produceed" should read --produced--.

COLUMN 17

Line 2, "is treated" should be deleted.
Line 33, "am" should read --an--.

COLUMN 18

Line 8,
" 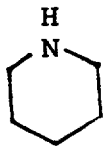 , 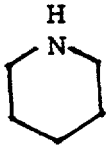 , " should read -- 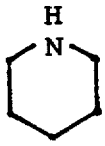 , 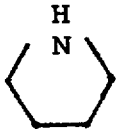 , --.

Line 32, "powder" should read --powders--.

UNITED STATES PATENT AND TRADEMARK OFFICE

CERTIFICATE OF CORRECTION

PATENT NO. : 5,406,357

DATED : April 11, 1995

INVENTOR(S) : TOSHIAKI NAKAHARA, ET AL.

It is certified that error appears in the above-identified patent and that said Letters Patent is hereby corrected as shown below:

COLUMN 19

Line 7, "to,each" should read --to each--.
Line 22, "end" should read --and--.
Line 37, "end" should read --and--.

COLUMN 20

Line 39, "member,and" should read --member, and--.

COLUMN 23

Line 45, "next" should read --the next--.

COLUMN 24

Line 33, "(t-butylperoxy)-" should read --(t-butylperoxycarbonyl)- --.

COLUMN 25

Line 22, "8.9 µm," hsould read --8.9 µm.--.
Line 45, ":region" should read --region--.
Line 60, "using;" should read --using--.

COLUMN 27

Line 33, "strontiumtitanate" should read --strontium titanate--.

COLUMN 28

Line 50, "Was" should read --was--.

--

UNITED STATES PATENT AND TRADEMARK OFFICE

CERTIFICATE OF CORRECTION

PATENT NO. : 5,406,357

DATED : April 11, 1995

INVENTOR(S) : TOSHIAKI NAKAHARA, ET AL.

It is certified that error appears in the above-identified patent and that said Letters Patent is hereby corrected as shown below:

COLUMN 29

Line 59, "least," should read --least--.
Line 64, "wherein;" should read --wherein:--.

COLUMN 32

Line 25, "comprises,an" should read --comprises an--.

COLUMN 33

Line 45, "0.24" should read --0.2%--.
Line 64, "wherein;" should read --wherein:--.

COLUMN 34

Line 40, "low molecular" should read --low-molecular--.
Line 43, "wherein;" should read --wherein:--.
Line 52, "100,00" should read --100,000--.
Line 53, "an" should read --than--.

COLUMN 35

Line 27, "wherein;" should read --wherein:--.

COLUMN 36

Line 10, "wherein;" should read --wherein:--.
Line 16, "100,00," should read --100,000,--.
Line 31, "aid" should read --said--.
Line 64, "medium molecular" should read --medium-molecular--.
Line 66, "300,000" should read --300,000,--.

UNITED STATES PATENT AND TRADEMARK OFFICE

CERTIFICATE OF CORRECTION

PATENT NO. : 5,406,357

DATED : April 11, 1995

INVENTOR(S) : TOSHIAKI NAKAHARA, ET AL.

It is certified that error appears in the above-identified patent and that said Letters Patent is hereby corrected as shown below:

COLUMN 37

Line 24, "having;" should read --having:--.

COLUMN 38

Line 4, "wherein;" should read --wherein:--.
Line 13, "100,00" should read --100,000--.

Signed and Sealed this

Twelfth Day of September, 1995

Bruce Lehman

*Attest:*

BRUCE LEHMAN

*Attesting Officer*

*Commissioner of Patents and Trademarks*